US009562754B2

(12) United States Patent
Peterson et al.

(10) Patent No.: US 9,562,754 B2
(45) Date of Patent: Feb. 7, 2017

(54) MUZZLELOADER SYSTEMS

(71) Applicant: VISTA OUTDOOR OPERATIONS LLC, Clearfield, UT (US)

(72) Inventors: Bryan P. Peterson, Isanti, MN (US); Drew L. Goodlin, Isanti, MN (US); Erik K. Carlson, Oak Grove, MN (US); Lawrence P. Head, Cambridge, MN (US); John W. Swenson, Ham Lake, MN (US); Sharon Jones, Dayton, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 14/869,619

(22) Filed: Sep. 29, 2015

(65) Prior Publication Data

US 2016/0091289 A1 Mar. 31, 2016

Related U.S. Application Data

(63) Continuation-in-part of application No. 14/041,648, filed on Sep. 30, 2013, now Pat. No. 9,146,086, and a continuation-in-part of application No. 14/041,951, filed on Sep. 30, 2013, now abandoned, and a continuation-in-part of application No. 14/041,452, filed on Sep. 30, 2013, now Pat. No. 9,329,003.

(60) Provisional application No. 61/707,520, filed on Sep. 28, 2012, provisional application No. 61/852,480, filed on Mar. 15, 2013, provisional application No. 61/802,264, filed on Mar. 15, 2013.

(51) Int. Cl.

| | |
|---|---|
| ***F42B 14/00*** | (2006.01) |
| ***F42B 30/02*** | (2006.01) |
| ***F42B 5/38*** | (2006.01) |
| ***F42B 8/04*** | (2006.01) |
| ***F41A 3/58*** | (2006.01) |
| ***F41A 9/37*** | (2006.01) |
| ***F41C 7/11*** | (2006.01) |
| ***F41C 9/08*** | (2006.01) |
| ***F42B 14/02*** | (2006.01) |
| ***F42B 14/06*** | (2006.01) |

(52) U.S. Cl.

CPC ..... *F42B 30/02* (2013.01); *F41A 3/58* (2013.01); *F41A 9/375* (2013.01); *F41C 7/11* (2013.01); *F41C 9/08* (2013.01); *F41C 9/085* (2013.01); *F42B 5/38* (2013.01); *F42B 8/04* (2013.01); *F42B 14/02* (2013.01); *F42B 14/064* (2013.01)

(58) Field of Classification Search

CPC ..... F42B 12/00; F41A 3/58; F41A 9/375; F41C 7/00; F41C 7/11; F41C 9/08

USPC ..... 42/51; 89/1.3

See application file for complete search history.

(56) References Cited

U.S. PATENT DOCUMENTS

| | | | |
|---|---|---|---|
| 39,112 | A | 7/1863 | Berney |
| 40,153 | A | 10/1863 | Billings |
| 1,559,183 | A | 10/1925 | Rimailho |

(Continued)

*Primary Examiner* — Samir Abdosh

(74) *Attorney, Agent, or Firm* — Christensen Fonder P.A.

(57) ABSTRACT

A bullet assembly comprising a bullet and a cup assembly, the cup assembly may have a ring portion for scraping the barrel of a muzzleloader. The cup assembly may be slidable on the bullet with an extended position and a contracted position, the contracted position having a greater diameter than the extended position. A contraction inhibiting member that requires shearing off of the member for contraction may be disposed on one of the components.

10 Claims, 19 Drawing Sheets

(56) References Cited

U.S. PATENT DOCUMENTS

| | | | | | |
|---|---|---|---|---|---|
| 1,850,034 | A | | 3/1932 | Samaia | |
| 2,383,053 | A | * | 8/1945 | Fanger | F42B 10/06 102/372 |
| 2,389,846 | A | | 11/1945 | Ericson | |
| 2,683,416 | A | | 7/1954 | Keller et al. | |
| 3,349,711 | A | * | 10/1967 | Darigo | F42B 12/80 102/509 |
| 3,583,087 | A | | 6/1971 | Huebner | |
| 3,726,231 | A | | 4/1973 | Kelly et al. | |
| 3,762,332 | A | | 10/1973 | Witherspoon et al. | |
| 4,126,954 | A | | 11/1978 | Plummer | |
| 4,137,663 | A | | 2/1979 | Farber | |
| 4,232,468 | A | | 11/1980 | Chapin | |
| 4,239,006 | A | | 12/1980 | Kelson | |
| 4,437,249 | A | | 3/1984 | Brown et al. | |
| 4,503,777 | A | * | 3/1985 | Young | F42B 12/80 102/507 |
| 4,815,682 | A | | 3/1989 | Feldmann et al. | |
| 4,918,849 | A | | 4/1990 | Spota | |
| 5,127,179 | A | | 7/1992 | Marsh | |
| 5,307,583 | A | | 5/1994 | Mahn et al. | |
| 5,339,743 | A | | 8/1994 | Scarlata | |
| 5,388,522 | A | | 2/1995 | Martwick et al. | |
| 5,458,064 | A | | 10/1995 | Kearns | |
| 5,487,232 | A | | 1/1996 | Osborne et al. | |
| 5,623,779 | A | | 4/1997 | Rainey, III | |
| 5,642,583 | A | | 7/1997 | Ball et al. | |
| 5,651,203 | A | | 7/1997 | Knight | |
| 5,706,598 | A | | 1/1998 | Johnston | |
| 5,777,256 | A | | 7/1998 | Simon et al. | |
| 5,822,904 | A | | 10/1998 | Beal | |
| 6,085,454 | A | | 7/2000 | Caudle | |
| 6,145,235 | A | | 11/2000 | Emerson et al. | |
| 6,216,380 | B1 | | 4/2001 | McGarity, Jr. et al. | |
| 6,314,670 | B1 | | 11/2001 | Rodney, Jr. | |
| 6,385,887 | B1 | | 5/2002 | Johnston | |
| 6,782,830 | B1 | | 8/2004 | Candland et al. | |
| 6,796,068 | B2 | | 9/2004 | Crowson et al. | |
| 6,895,865 | B2 | | 5/2005 | Bond | |
| 7,201,104 | B2 | | 4/2007 | McMurray et al. | |
| 7,219,607 | B2 | | 5/2007 | Oertwig | |
| 7,380,505 | B1 | | 6/2008 | Shiery | |
| 7,451,705 | B2 | | 11/2008 | Fry | |
| 7,621,064 | B2 | | 11/2009 | Laney et al. | |
| 7,726,245 | B2 | | 6/2010 | Quesenberry et al. | |
| 7,877,919 | B2 | | 2/2011 | Richards | |
| 8,132,348 | B1 | | 3/2012 | Post | |
| 9,146,086 | B2 | * | 9/2015 | Peterson | F41A 3/00 |
| 2002/0035800 | A1 | | 3/2002 | Lewis | |
| 2002/0129531 | A1 | | 9/2002 | Camp | |
| 2004/0050285 | A1 | | 3/2004 | Zozulya et al. | |
| 2005/0005807 | A1 | | 1/2005 | Wiley et al. | |
| 2005/0016050 | A1 | | 1/2005 | Howell, Jr. | |
| 2005/0183318 | A1 | | 8/2005 | McGivern | |
| 2006/0027128 | A1 | | 2/2006 | Hober | |
| 2006/0027130 | A1 | | 2/2006 | Parker | |
| 2006/0027131 | A1 | | 2/2006 | Byer | |
| 2006/0086029 | A1 | | 4/2006 | Kirkpatrick | |
| 2008/0282596 | A1 | | 11/2008 | Deleeuw | |
| 2010/0126370 | A1 | | 5/2010 | O'Dwyer | |
| 2011/0296729 | A1 | | 12/2011 | Overstreet | |
| 2012/0090492 | A1 | | 4/2012 | Rebar | |
| 2012/0180687 | A1 | | 7/2012 | Padgett et al. | |
| 2012/0260814 | A1 | | 10/2012 | Worrell et al. | |
| 2014/0090284 | A1 | | 4/2014 | Peterson et al. | |
| 2014/0090285 | A1 | | 4/2014 | Peterson et al. | |
| 2014/0130699 | A1 | | 5/2014 | Peterson et al. | |
| 2014/0318402 | A1 | | 10/2014 | Carlson et al. | |

* cited by examiner

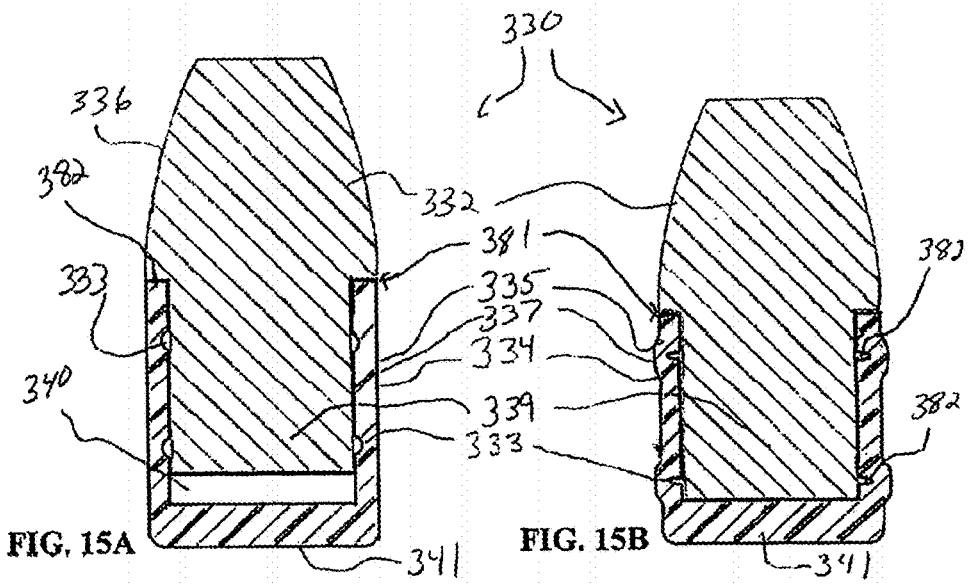
FIG. 15A
FIG. 15B
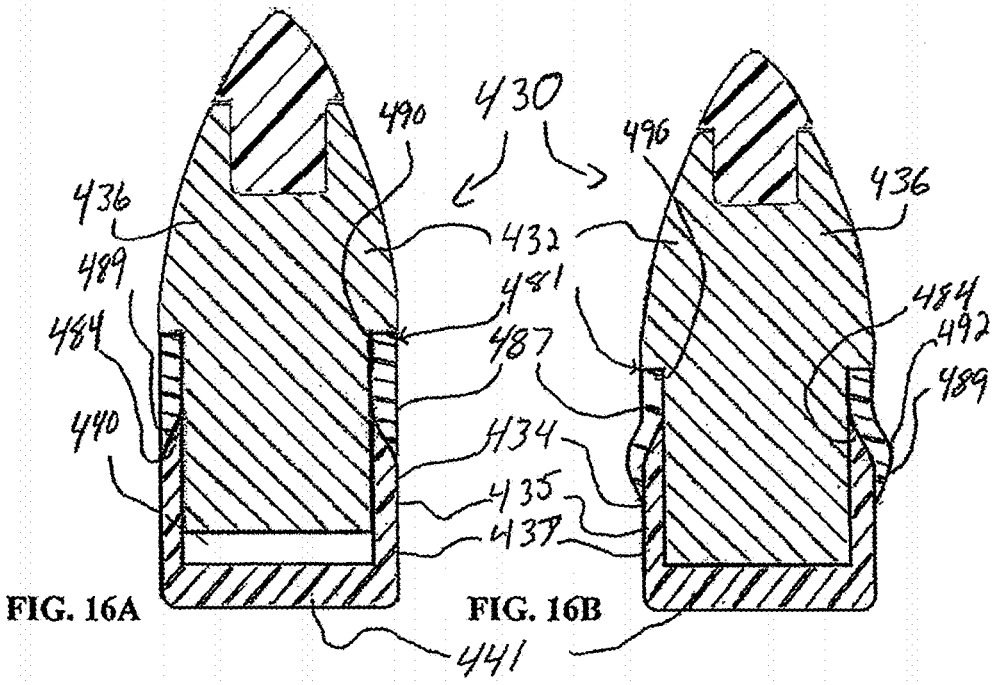
FIG. 16A
FIG. 16B

MUZZLELOADER SYSTEMS

RELATED APPLICATIONS

This application is a continuation-in-part application of U.S. patent application Ser. No. 14/041,648, filed Sep. 30, 2013, now U.S. Pat. No. 9,146,086, which claims priority to U.S. Provisional Application No. 61/707,520, filed Sep. 28, 2012, U.S. Provisional Application No. 61/852,480, filed Mar. 15, 2013, and U.S. Provisional Application No. 61/802,264, filed Mar. 15, 2013, each of which is hereby fully incorporated herein by reference. This application also claims priority to U.S. Provisional Application No. 62/096,660, filed Dec. 24, 2014, which is incorporated herein by reference. This application also is a continuation-in-part application of U.S. patent application Ser. No. 14/041,951, filed Sep. 30, 2013, which claims priority to U.S. Provisional Application No. 61/707,520, filed Sep. 28, 2012, U.S. Provisional Application No. 61/852,480, filed Mar. 15, 2013, and U.S. Provisional Application No. 61/802,264, filed Mar. 15, 2013, each of which is hereby fully incorporated herein by reference. This application also is a continuation-in-part of U.S. patent application Ser. No. 14/041,452, filed Sep. 30, 2013, which claims priority to U.S. Provisional Application No. 61/707,520, filed Sep. 28, 2012, U.S. Provisional Application No. 61/852,480, filed Mar. 15, 2013, and U.S. Provisional Application No. 61/802,264, filed Mar. 15, 2013, each of which is hereby fully incorporated herein by reference.

FIELD OF THE DISCLOSURE

The present disclosure is directed to systems for muzzleloaders.

BACKGROUND OF THE DISCLOSURE

Muzzleloaders are a class of firearms in which the propellant charge and bullet are separately loaded into the barrel immediately prior to firing. Unlike modern breech loaded firearms where the bullet, propellant charge and primer are loaded as prepackaged cartridges, conventional muzzleloaders are loaded by feeding a propellant charge through the muzzle of the barrel before ramming a bullet down the barrel with a ramrod until the bullet is seated against the propellant charge at the breech end of the barrel. A primer is then typically fitted to the exterior end of a hole in the breech end of the barrel. The primer is then struck by an internal in-line firing pin or an external hammer to ignite the propellant charge through the hole in the breech end of the barrel to ignite the propellant creating propellant gases for propelling the bullet.

The loading process of muzzleloaders creates issues unique to muzzleloaders. Specifically, the muzzleloader loading process requires that, unlike conventional breech loaded firearms, the bullet travel through the barrel twice, once during loading and once during firing. The tight fit of the bullet to the barrel can create substantial friction as the bullet travels through the barrel and is etched by the barrel rifling. During firing, the expanding propellant gases can overcome the frictional forces to propel the bullet through the barrel. However, during loading, the user must overcome the frictional force by applying an axial force to the bullet with the ramrod until the bullet is seated against the propellant charge. The friction between the bullet and the barrel can complicate the determination as to whether the bullet has been pushed far enough down the barrel during loading and is properly seated against the propellant charge. The relative position of the bullet to the propellant charge changes the pressurization of the barrel behind the bullet from the ignited propellant gases impacting the ballistic performance and potentially creating a substantial safety risk.

A recent trend in muzzleloading is placing an undersized bullet within a polymer sabot in a barrel sized for a larger caliber bullet. The undersized bullet has a higher muzzle velocity than the larger caliber bullet providing improved ballistic characteristics. The sabot is sized to approximate the inner diameter of the barrel such that the sabot tightly seals against the barrel to efficiently propel the bullet and engage the rifling of the barrel to impart spin to the bullet. The sabot typically comprises a plurality of pedals or other unfurling element that unfurl from the bullet to separate the sabot from the bullet as the bullet leaves the muzzle to disengage from the bullet. While the sabot substantially improves the ballistic performance of the muzzleloader, the polymer sabot can be damaged or deformed by passing through the barrel and engaging the rifling twice. The deformation of the sabot or damage to the sabot can cause the sabot to release the bullet prematurely or impart a wobble to the bullet or otherwise affect ballistic performance.

A concern with muzzleloaders is that the slower burning propellant required by muzzleloaders often foul the barrel with unconsumed residue requiring frequent cleaning of the barrel. The fouling often occurs so quickly that the barrel may need to be cleaned after every shot. The fouling can also interfere with the operation the sabot. In addition to contributing the fouling of the barrel, the deformation or damage to the sabot can impart wobble into the bullet or otherwise impact the ballistic performance of the bullet.

An additional complication is that the actual inner diameter of the barrel for given caliber can vary from manufacturer to manufacturer. A 50 caliber barrel can have an actual inner diameter ranging from 0.497 to 0.505 inches depending on the manufacturer. Similarly, a 45 caliber bullet saboted for use in a 50 caliber barrel can have an outer diameter varying from 0.450 to 0.452 inches, which in turn changes the outer diameter of the sabot the bullet is seated within. Although the variance is relatively small, the variance in tolerances between the inner diameter of the barrel and the outer diameter of the sabot can result in substantially increased friction between the cupped bullet and the barrel, which can cause the bullet to become stuck within the barrel during firing or loading. Similarly, an improper fit between the barrel and an undersized sabot can create an inefficient seal between the sabot and the barrel allowing gases to escape around the bullet during firing. Accordingly, if the sabot-bullet pairing is not properly selected, the effectiveness of the muzzleloader can be substantially impacted.

Variability in muzzleloaders not present in cartridge based firearms include the size/amount of the propellant charge. Unlike cartridge firearms where a cartridge is preloaded with a bullet and premeasured quantity of propellant is loaded into the firearm for firing, the bullet and propellant charge are combined within the firearm for firing. Accordingly, the muzzleloader operator can attempt to select the optimal bullet, propellant type and quantity combination for each shot, which is particularly advantageous given the long reloading time for muzzleloaders. While the variability of the bullet-propellant charge combination can allow for an optimized shot, varying the bullet and in particular the propellant and quantity of propellant can significantly change the appropriate seating depth of the bullet. With loose or powdered propellant such as black powder, the amount of propellant is often varied between 80 and 120 volumetric grains. Similarly, propellants are often formed into cylindrical pellets that are stacked end-to-end within the barrel to form the propellant charges. The pellets are typically each about 1 cm in length and loaded in 1 to 3 pellet groups causing an even greater variation in the seating depth.

A common approach to determining whether a bullet has been properly seated involves marking the ramrod with a visual indicator that aligns with the muzzle of the barrel when the end of the ramrod is at the appropriate depth with the barrel. The visual indicator is typically marked by loading the propellant charge and ramming a test bullet through the barrel. Once the user is certain that the bullet is properly seated against the propellant charge, the corresponding portion of the ramrod at the muzzle is marked. Although this approach is relatively easy to implement and widely used, the visual indicator approach detracts from the primary advantages of muzzleloaders. As the visual indicator approach is set based on a particular propellant charge and bullet combination, a variation in the propellant charge that changes the dimensions of the propellant charge can render the visual indicator at best useless or at worse a safety risk giving a false appearance of a properly seated bullet.

Due to the time required for loading muzzleloaders, when hunting the muzzleloader is typically loaded. If not fired during hunting, the muzzleloader needs to be unloaded. While firing the muzzleloader can be one way to eliminate the unloading issue, at times firing may not be practical and unloading a conventional muzzleloader can be very difficult.

One approach to addressing the reloading problem is replacing the closed breech end of the muzzleloader barrel with a screw-in, removable breech plug. The breech plug is removable from the breech end of the muzzle to remove the propellant charge from behind the bullet, rather than attempting to first remove the bullet from the muzzle end of the barrel and then the propellant. While the approach is effective in safely separating the propellant charge from the bullet, a common problem with removable breech plugs is seizing of the breech plug within the barrel. The rapid temperature changes during firing as well as the corrosive nature of many of the propellants can result in seizing of the corresponding threads of the breech plug and the barrel.

A related concern is that the performance of the hygroscopic propellant itself can be easily and often detrimentally impacted by the environmental conditions in which the propellant is stored. The sensitivity of the propellant can often result in "hang fires" where the ignition of the propellant charge is delayed or the propellant charge fails to ignite altogether. Hang fires are frequent occurrences and create a substantial risk for the user. The conventional approach to dealing with a hang fire is to point the muzzleloader in a safe direction until the muzzleloader fires or until sufficient time has passed to reasonably assume that the propellant charge failed to ignite altogether. The unloading process through the muzzle of the muzzleloader is particularly dangerous in hang fire situations as the propellant charge may ignite during the actual unloading process. Similarly, unloading through a breech plug can similarly be dangerous as the propellant charge may ignite as the breech plug is removed.

Another safety concern unique to muzzleloaders is an undersized or oversized propellant charge. Unlike cartridge firearms where the amount of propellant loaded for each shot is limited by the internal volume of the cartridge, the amount of propellant loaded for each shot in muzzleloaders is only limited by the length of the barrel. While measures are often used to provide a constant quantity of propellant for each propellant charge, the measures can be difficult to use in the field or in low light situation when hunting often occurs. Similarly, propellant can be formed into the pre-sized pellets that can be loaded one at a time until the appropriate amount of propellant is loaded. As with the measuring, loading the appropriate number of pellets can be challenging in the field or in low light situations.

Addressing issues and difficulties with muzzleloaders such as described above would be welcome by the industry and market.

SUMMARY

The present disclosure relates to systems for muzzleloaders, in particular bullet assemblies suitable for muzzleloaders. In an embodiment of the present disclosure, a bullet assembly with components that translate axially with respect to one another, the components including a radially deforming polymer component that radially expands upon firing or forced seating of the bullet to seal the bullet assembly against the walls of the barrel. The bullet assembly has an extended mode and a contracted mode. The contracted mode associated with a radially expanded rearward polymer component having a sleeve component.

In embodiments, a bullet assembly for a muzzleloader comprises a bullet and a cup assembly. The bullet includes a forward tapered end and a rearward tail portion, the tail portion having a circumferential recessed portion. The cup assembly can be slidingly engaged on the tail portion of the bullet and comprises a cup component having a tubular side wall having an inner surface, an outer surface, an end wall and an axis and defining an open cavity that receives the tail portion of the bullet at an open end.

The cup assembly can further comprise a bottom wall having an inner surface and an outer surface defining a closed end. The cup component can further comprise contraction inhibiting portions or members, such as plurality of protrusions in the cup for engaging the bullet and to keep the bullet assembly in the extended mode during loading. The protrusions may be configured as posts extending axially and radially inward and unitary with the tubular side wall. When the bullet assembly is in the extended mode, the inward protrusions are positioned between the tail portion and the bottom wall, axially separating the tail portion from the bottom wall.

In embodiments, the cup component is formed of a deformable polymer material. In embodiments, the cup assembly further comprises a tail component configured as an end cap engaging the rearward surface of the bottom wall. The tail component can be formed of a material that is more rigid that the polymer material of the cup component and can scrape the barrel when the bullet assembly is loaded into a muzzleloader. The tail component can be generally disc shaped and positioned parallel with the bottom wall.

In some aspects, the plurality of inward protrusions have forward stop surfaces facing forwardly and are arranged around the axis, adjacent to the bottom wall, and wherein the tail portion of the bullet includes a bottom aligned with the axis. When the bullet is inserted in the cavity, the tail end surface is axially directly over the forward stop surfaces.

In embodiments of the invention, such as described above, the cup is slidably secured to the bullet such that when the bullet assembly is fired from the muzzleloader, the cup remains secured to the bullet in the contracted mode.

In further embodiments, a bullet assembly for muzzleloading having an axis, an extended condition, wherein the bullet assembly has a first length, and a contracted condition, wherein the bullet assembly has a second length. Upon the application of a threshold of axial force, the bullet assembly transitions from the extended condition to the contracted condition.

In embodiments, the bullet assembly comprises a bullet having an axis end, a rearward tail portion having a reduced diameter portion, and a shoulder portion. The shoulder portion is axially positioned between the forward tapered end and the recessed portion. The bullet assembly further comprises a cup assembly recurring the tail portion of the bullet. The cup assembly extends shaped around the axis and having a length, a forward end positionally secured to the bullet at or adjacent to the shoulder portion and a rearward end. When the bullet assembly transitions from the extended condition to the contracted condition, the cup assembly foreshortens to a second length causing a radial expansion. In embodiments, the forward end of the cup assembly remains fixed relative to the bullet and the rearward end moves relative to the bullet. In embodiments, an annular outer portion remains fixed and an inner portion contracts.

In embodiments, the cup assembly comprises a cup component and an outer sleeve component being tubularly shaped around the recessed portion of the tail portion of the bullet. The cup component comprises a side wall positioned around the tail portion of the bullet within the outer sleeve component and a bottom wall rearwardly situated from the bullet along the axis. When the bullet assembly transitions from the extended condition to the contracted condition, the cup component moves axially relative to the bullet, such that the bottom wall moves closer to the tail portion of the bullet. The outer sleeve component does not slide relative to the bullet, such that the side wall slides between the outer sleeve component and the tail portion.

In some embodiments, the outer sleeve component and the cup component are formed from dissimilar polymer materials. The bottom wall radially extends upon transition to the contracted condition. In some embodiments, a forward end of the side wall is spaced from the shoulder portion in the extended condition. Embodiments can comprise at least one inner or outer circumferential projection formed between facing surfaces of the outer sleeve component and the side wall, engaging side wall to the outer sleeve component in the contracted condition.

In some embodiments, the cup component can further comprise at least one weakened portion imparted in the side wall around the axis, wherein, upon transitions from the expanded condition to the contracted condition, the side wall buckles at the weakened portion, foreshortening the cup component. In some embodiments, the weakened portion is in the form of a groove in an inner surface of the side wall.

In some further embodiments, the cup assembly comprises a cup component and a forward sleeve component being tubularly shaped around the reduced diameter portion of the tail portion of the bullet. The cup component comprises a side wall positioned around the tail portion of the bullet having a forward end adjacent to a rearward end of the forward sleeve component and being substantially axially aligned with and rearward of the forward sleeve component and a bottom wall rearwardly situated from the bullet along the axis. When the bullet assembly transitions from the extended condition to the contracted condition, the cup component moves axially relative to the bullet, such that the bottom wall moves closer to the tail portion of the bullet and the forward end of the cup side wall moves forward and under the rearward end of the forward sleeve component, and the outer sleeve component remains substantially axially stationary relative to the bullet. In some embodiments, the forward sleeve component and the cup component are formed from dissimilar polymer materials.

Various embodiments include the cup assembly comprising an inner cup component and an outer cup component, the inner cup component being stationary relative to the bullet during transition to the contracted condition and the outer cup component being inside the outer cup component and movable relative to the bullet during the transition. Both have a side wall and a bottom wall, wherein each side wall is tubularly shaped around the recessed portion of the tail portion of the bullet. Each of the side walls includes a forward end. The upper cup component comprises a forward portion having a first thickness and a rearward portion having a second thickness less than the first. The side wall of the outer cup component is radially position around the rearward portion with the first end of the outer cup component being adjacent to a transition point between the forward and rearward portions. When the bullet assembly transitions from the extended condition to the contracted condition, the outer cup component moves axially relative to the bullet, such that its bottom wall moves closer to the tail portion of the bullet and the forward end of the cup side wall moves forward and over the forward portion of the inner cup component, the inner cup component remaining substantially axially stationary relative to the bullet. In some embodiments, the inner cup component and the outer cup component are formed from dissimilar polymer materials.

In some embodiments, the cup assemblies of the embodiments can be formed by an overmolding process. A method of forming an embodiment of a cup assembly comprises overmolding a cup component onto a tail component or vice versa.

These and other aspects of the present disclosure will become apparent to those skilled in the art after a reading of the following description of the preferred embodiment when considered with the drawings.

BRIEF DESCRIPTION OF THE DRAWINGS

FIG. 15A is a cross-section view along the axis of a projectile according to an embodiment of the invention in an axial extended condition.

FIG. 15B is a cross-section view along the axis of the projectile of FIG. 15A in an axial contracted condition.

FIG. 16A is a cross-section view along the axis of a projectile according to an embodiment of the invention in an axial extended condition.

FIG. 16B is a cross-section view along the axis of the projectile of FIG. 16A in an axial contracted condition.

Figure 1A:
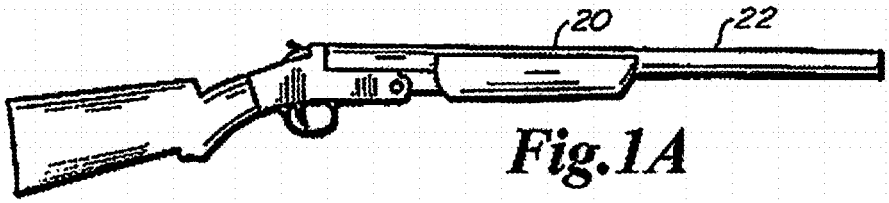
FIG. 1A is an elevation view of a muzzleloader shown in cross-section in FIGS. 1B-4 illustrating embodiments of the invention.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 1B:
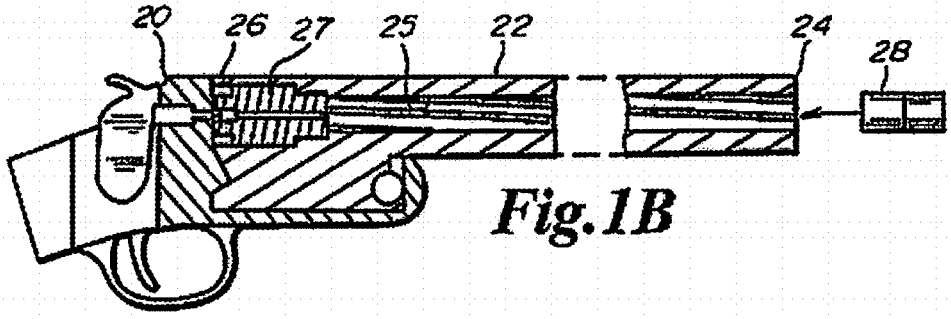
FIG. 1B is a cross-sectional side view of a muzzleloader for use with the present invention.
Figure 2:
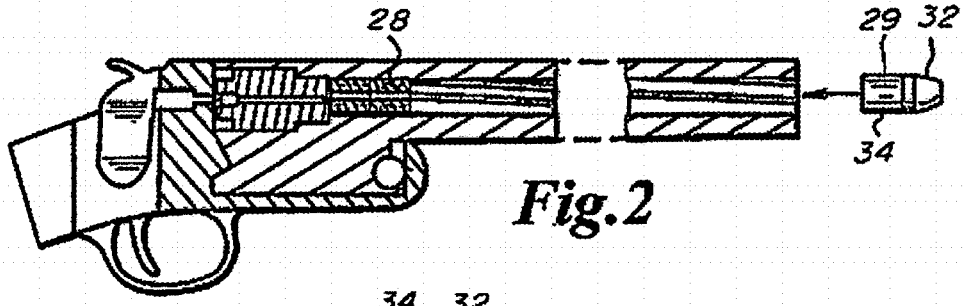
FIG. 2 is a cross-sectional side view of a muzzleloader with a propellant charge positioned at a breech end of the barrel and a conventional bullet positioned at a muzzle end of the barrel.
Figure 3:
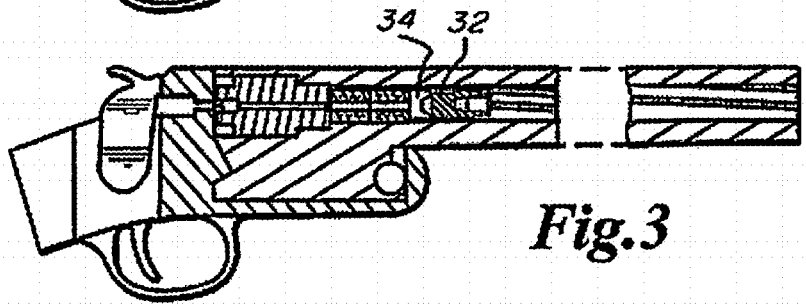
FIG. 3 is a cross-sectional side view of the muzzleloader depicted in FIG. 2, with the conventional bullet pushed partially through the barrel with a ramrod.
Figure 4:
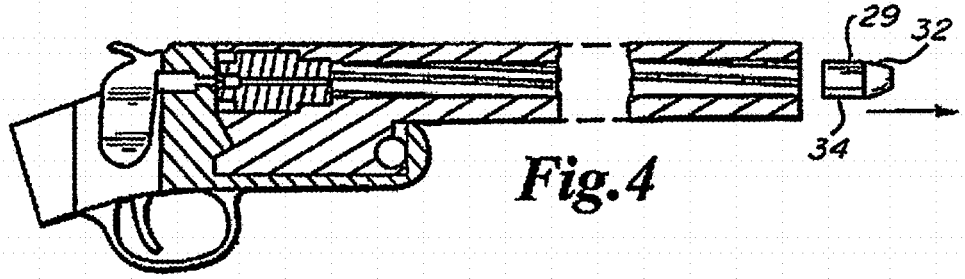
FIG. 4 is a cross-sectional side view of the muzzleloader depicted in FIG. 2 with the conventional bullet being fired.

Referring to FIGS. 1A-5, a muzzleloader 20, for use with the present invention, generally comprises a barrel 22 having a muzzle 24, a breech end 26 with a breech plug 27 therein. The barrel 22 can comprise smooth bore or a rifled bore 25 as depicted in FIG. 1. As depicted in FIGS. 2-4, the muzzleloader 20 may be conventionally loaded by loading a propellant charge 28 through the muzzle 24 of the barrel 22 and pushing the propellant charge 28 toward the breech end 26 of the barrel 22. A projectile 29, with a bullet, and a shiftable cup assembly 34 on the tail of the bullet, according to the invention is positioned in the muzzle 24 of the barrel 22 before being pushed down the barrel 22 with the ramrod until the bullet is seated against the propellant charge 28, as shown in FIG. 3. The muzzleloader is then ready to be fired and the bullet is in an axially extended condition. FIG. 4 illustrates the muzzleloader after the bullet has been fired, the bullet in an axially contracted or compressed state and with an expanded circumference.

Figure 5A:
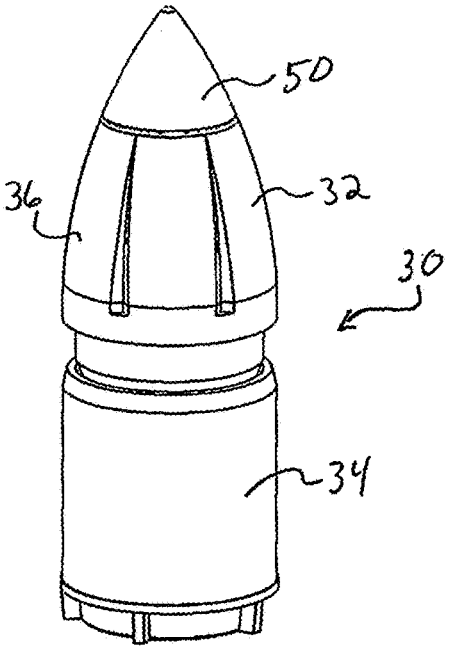
FIG. 5A is a front perspective view of a projectile according to an embodiment of the invention in an axial extended condition.
Figure 5B:
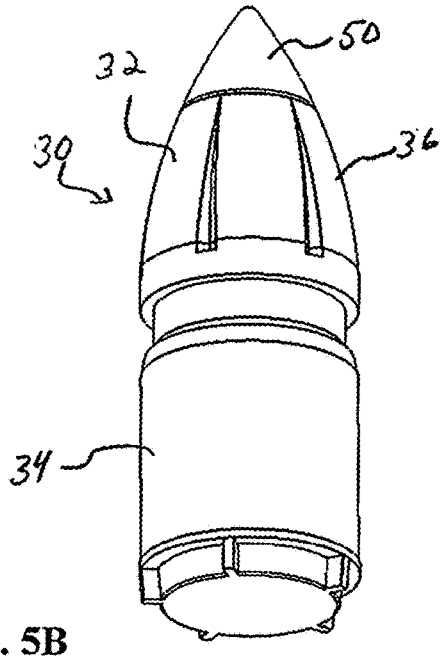
FIG. 5B is a rear perspective view of the projectile of FIG. 5A.
Figure 5C:
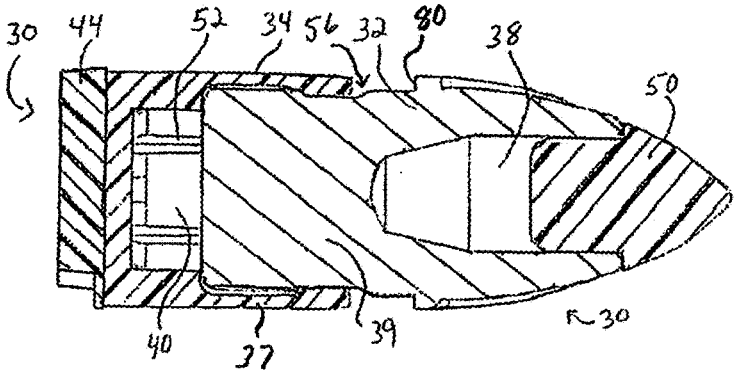
FIG. 5C is a cross-sectional side view along the axis of the projectile of FIG. 5A in its extended condition.
Figure 5D:
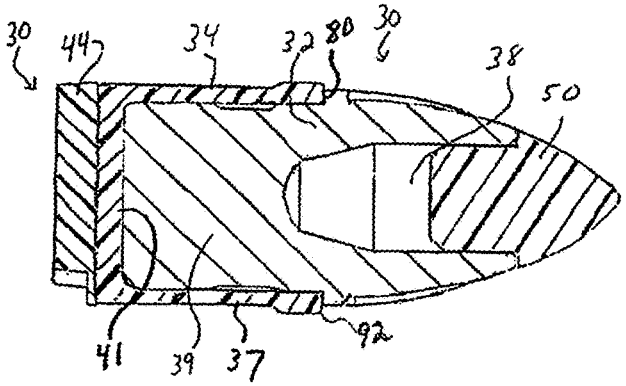
FIG. 5D is a cross-sectional side view along the axis of the projectile of FIG. 5A in its contracted condition.
Figure 5E:
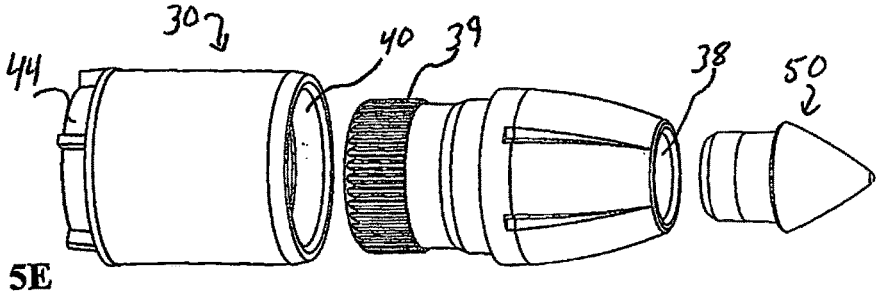
FIG. 5E is an exploded view of the projectile of FIG. 5A.

Referring to FIGS. 5A-5E and 6-10D, embodiments of a bullet assembly 30 and components are illustrated. Bullet assembly 30 comprises a bullet 32 having a head portion 36 and a cup assembly 34. The cup assembly includes a well cavity 40 configured to receive the tail portion 39 of the bullet 32. The bullet can be configured to receive a tip insert 50. FIGS. 5C-E show illustrations of the arrangement of an embodiment of the cup assembly 34, the bullet 32 and the tip insert 50. FIG. 5C shows the bullet assembly 30 in its extended condition and FIG. 5D shows the bullet assembly in its contracted condition.

Figure 7A:
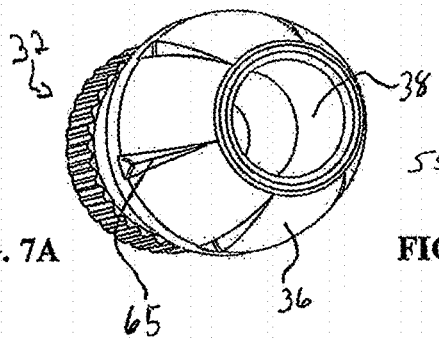
FIG. 7A is a front perspective view of a bullet according to an embodiment of the invention.
Figure 7B:
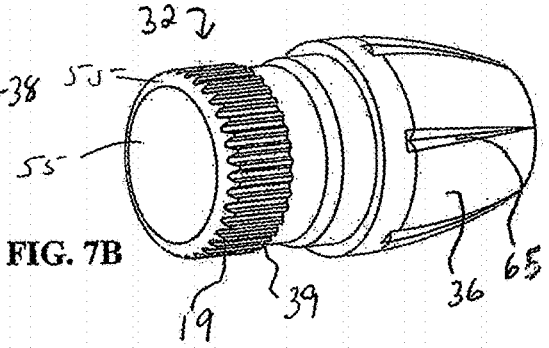
FIG. 7B is a rear perspective view of the bullet of FIG. 7A.
Figure 7C:
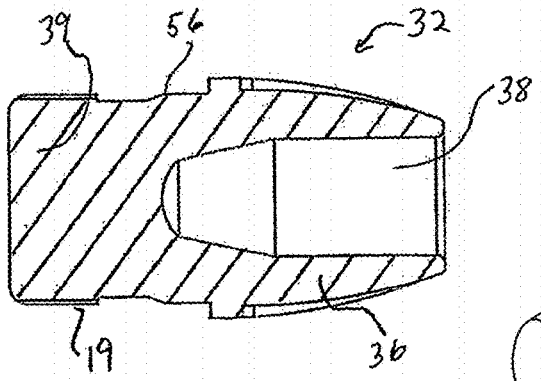
FIG. 7C is a cross-sectional side view along the axis of the bullet of FIG. 7A, according to an embodiment of the present invention.
Figure 6:
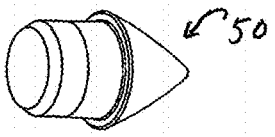
FIG. 6 is a rear perspective view of the nose insert shown in FIG. 5E.

FIGS. 7A-7C show an embodiment of the bullet 34. The bullet 32 comprises a forward tapered end configured as a tapered head portion 36, a tapered or cam surface 56 and a generally cylindrical tail portion 39 configured to be received in the cup assembly 34. The tail portion has a multiplicity of ribs to inhibit rotation of the bullet with respect to the cup. The bullet well cavity 38, which can be optionally included, may receive the tip insert 50 and can operate as a hollow point tip facilitating mushrooming of the bullet upon impact to increase the damage to the target caused by the bullet. As depicted in FIGS. 7A and 7B, the tapered head portion 36 of the bullet 32 can further comprise score lines 65 shaped to facilitate mushrooming of the tapered head portion 36 upon impact with the target. In some embodiments, tail portion 39 includes a plurality of axially-extending stabilizing ridges 19 distributed about a circumference of tail portion 39.

The bullets herein can be formed from any suitable material known in the industry. Examples of suitable materials include lead, copper, steel, aluminum, any suitable metallic and lead-free material, a metallic/polymer composition, a polymer based material or other alloys or other metals. In some aspects, the bullet may be jacketed with suitable materials, including copper and any other suitable jacket material.

Figure 5F:
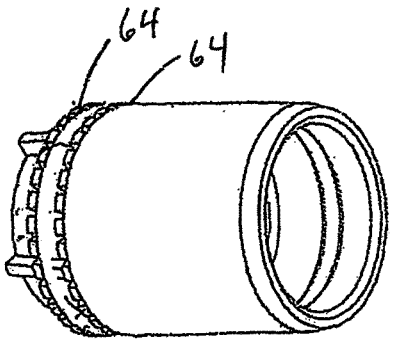
FIG. 5F is a perspective view of a cup with two cutting rings.
Figure 5G:
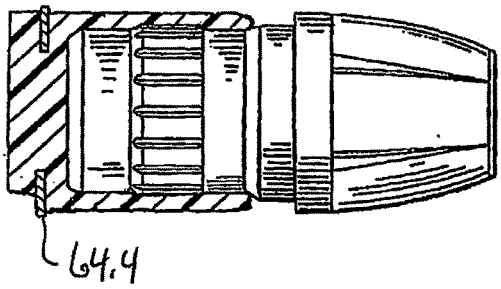
FIG. 5G is a cross-sectional view of a projectile with a cutting ring.
Figure 5H:
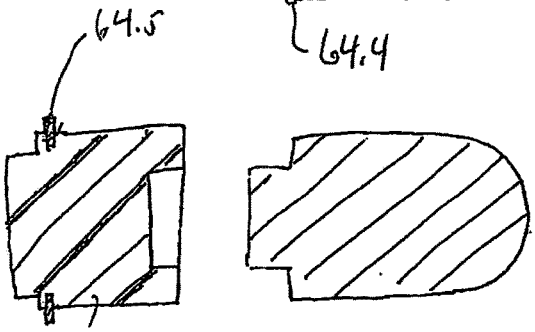
FIG. 5H is a cross-sectional exploded view of a projectile with a cutting ring.
Figure 5I:
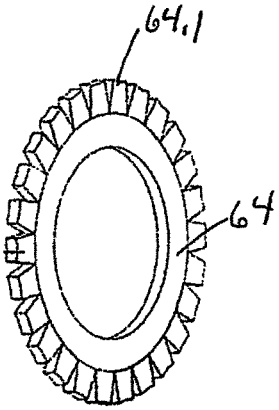
FIG. 5I is a perspective view of a cutting ring such as is illustrated in the cup of FIG. 5F.

Referring to FIGS. 5F and 5I, a cup may have one or more ring portions configured as scrapping rings 64 formed of metal or other material and with serrations defined by individual cutting fingers 64.1. FIGS. 5G and 5H illustrates a cup with a partially embedded ring portions configured as metal rings 64.4, 64.5.

Referring to FIGS. 8A-10D, in some embodiments, the cup assembly 34 comprises a cup component 37 having a side wall portion 35 and a bottom wall portion 41 and a tail component 44. The side wall portion 35 can be generally tubular and axially aligned and comprises a radially deforming polymer component. The tail component 44 can be generally disc-like and is perpendicularly oriented relative to the axis 43 (also the axis of the bullet assembly 30) of the tubular side wall portion 35. The side wall portion 35, bottom wall portion 41 and in some embodiments the tail component 44 define the well cavity 40 having a forward open end 42 and a rearward closed end 45.

Figure 8A:
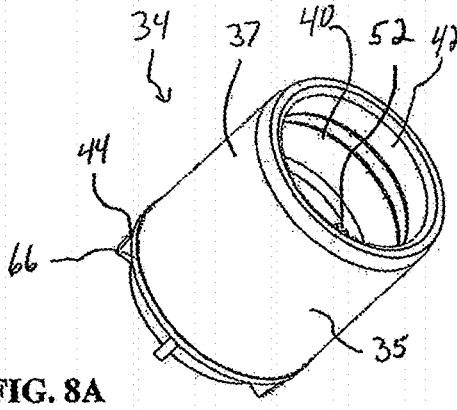
FIG. 8A is a front perspective view of a cup assembly according to an embodiment of the invention.
Figure 8B:
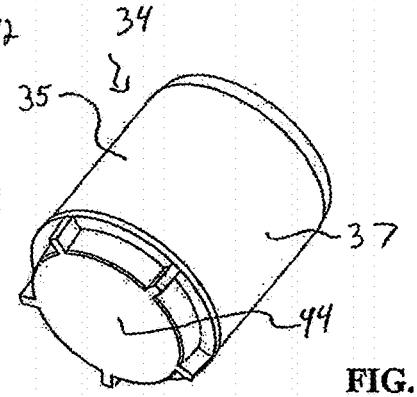
FIG. 8B is a rear perspective view of the cup assembly of FIG. 8A.
Figure 8C:
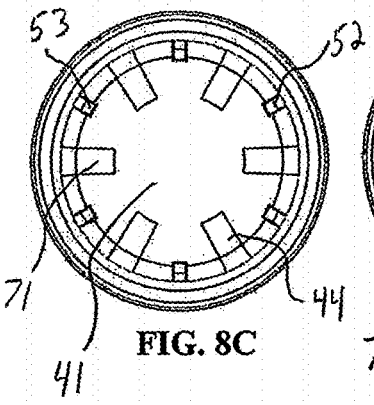
FIG. 8C is a top plan view of the cup assembly of FIG. 8A.
Figure 8D:
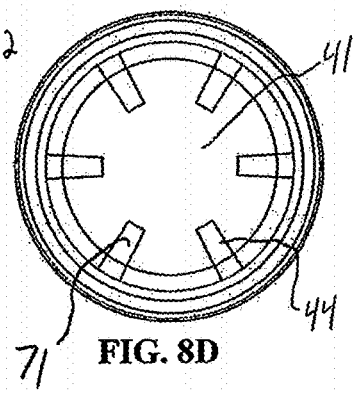
FIG. 8D is a top plan view of a cup assembly without inward protrusions.
Figure 8E:
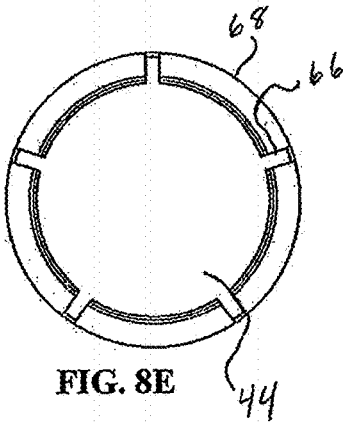
FIG. 8E is a bottom plan view of the cup assembly of FIG. 8A.
Figure 8F:
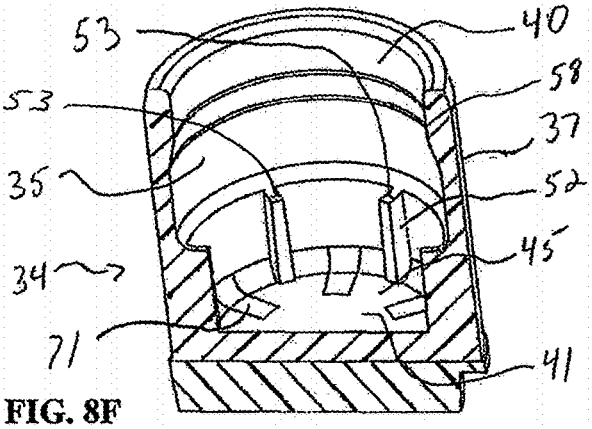
FIG. 8F is a front perspective cross-sectional view of the cup assembly of FIG. 8A.

In some embodiments of the invention, the cup component 37 has one or several internal contraction inhibiting members that generally deform, such as by that collapsing, shearing off, tearing, and/or disintegrating during contraction. Protrusions 52, such as posts at the rearward closed end 45 of the well cavity project axially and extend inwardly from the side wall portion 35. In some embodiments, the inward protrusions can be in the form of internal axial rib(s) 52 and extend internally and axially along the side wall portion 35. The inward protrusions can project and extend upward from the bottom wall portion 41 or may be spaced from the bottom wall portion 41. FIG. 8F shows at least a portion of the inward protrusions 52 extending from the bottom wall portion 41 and up the side wall portion 35.

In some embodiments, the inward protrusion(s) 52 (one or more) can be circumferentially oriented around the side wall portion 35, spaced from the bottom wall portion 41. In such embodiments, there can be one or more single circumferentially oriented inward protrusions (inner extending rings), axially spaced if there are more than one. In some embodiments, the circumferentially oriented inward protrusions can comprise a plurality of protrusions circumferentially aligned in the form of a ring.

The inward protrusions 52 can be separate parts secured to the side wall portion 35 or integral with either or both the side wall portion 35 and the bottom wall portion 41. In some embodiments, the inward protrusions 52 are evenly distributed at the rearward closed end 45 around the axis 43 of the side wall portion 35.

In embodiments, the contraction inhibiting members provide forward facing stop surfaces 53 for engagement of the rearward force 55 of the bullet or intermediary component.

In embodiments, the inward protrusions 52 effectively reduce the inner diameter of the lower portion of the cup component 37. When the bullet 32 is inserted into the cup assembly 34, the bottom of the tail portion 39 of the bullet 32 adjacent to or on forward surfaces 53 of the inward protrusions 52. The inward protrusions 52 can function to block or inhibit the bullet 32 from collapsing into the cup component 37 or seating at the bottom of the well cavity 40. The inward protrusions 52 can further function to inhibit collapse and contraction of the bullet assembly 30 during loading, maintaining a separation of components during.

Figure 11A:
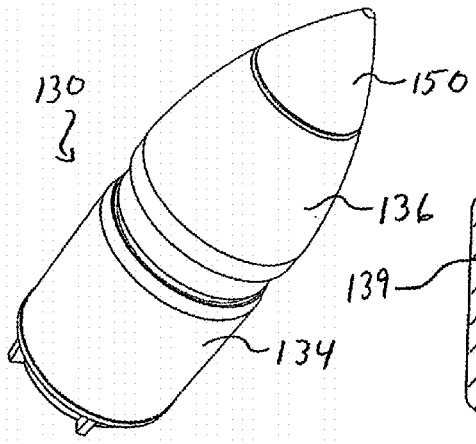
FIG. 11A is a front perspective view of a projectile according to an embodiment of the invention in an axial extended condition.
Figure 12:
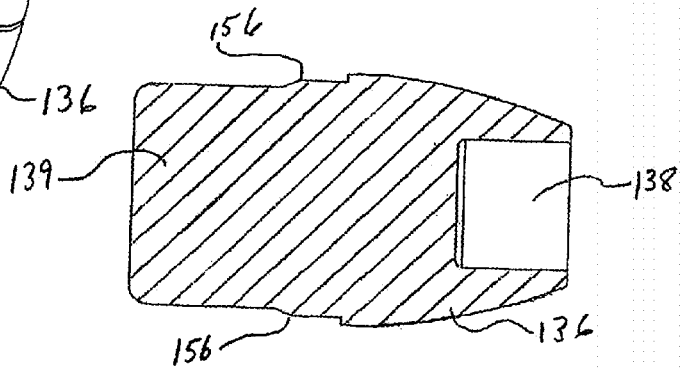
FIG. 12 is a cross-sectional side view along the axis of a bullet of FIG. 11A.
Figure 11B:
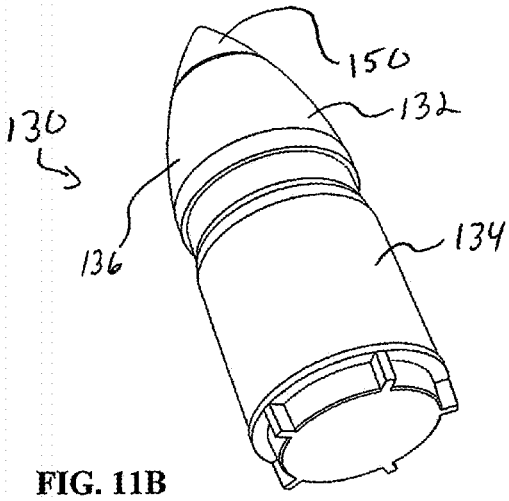
FIG. 11B is a rear perspective view of the projectile of FIG. 11A.
Figure 11C:
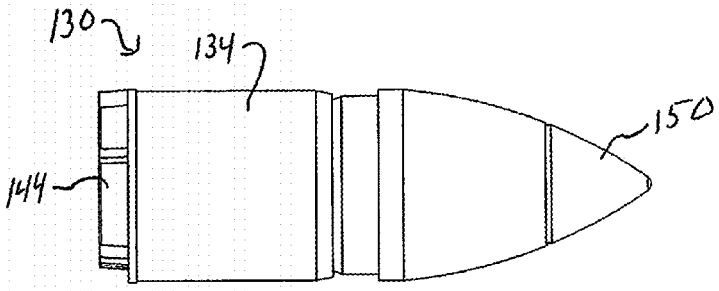
FIG. 11C is a side elevation view of the projectile of FIG. 11A.
Figure 11D:
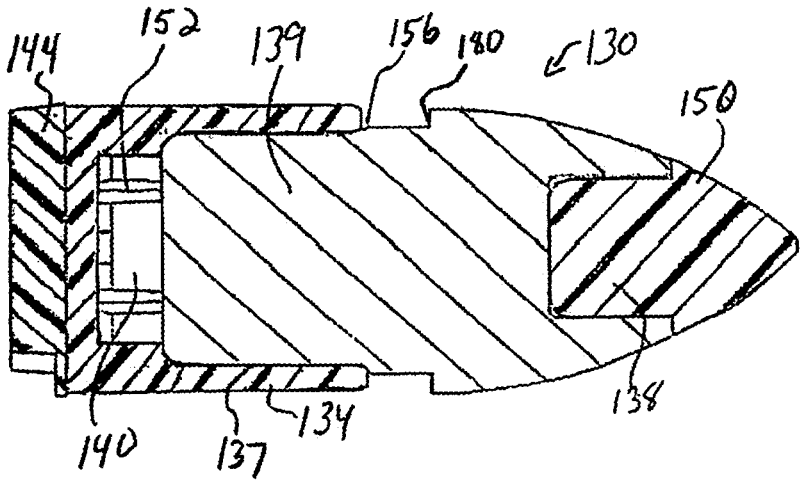
FIG. 11D is an axial cross-sectional view of the projectile of FIG. 11A in its extended condition.
Figure 11E:
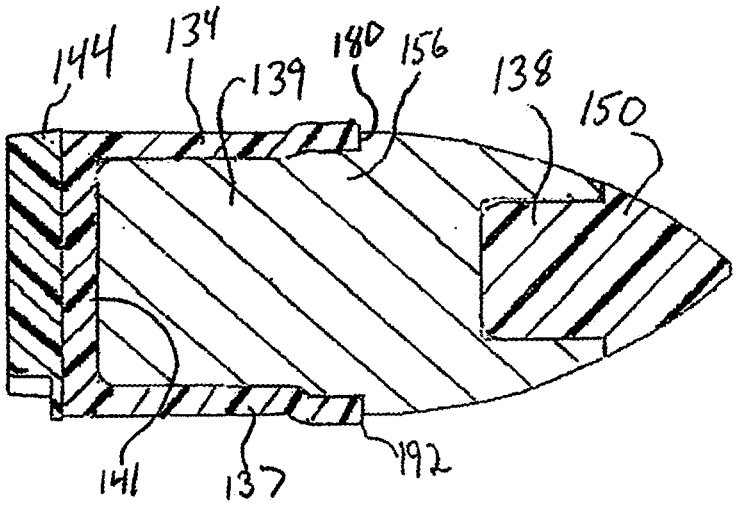
FIG. 11E is an axial cross-sectional view of the projectile of FIG. 11A in its contracted condition.

Upon firing or forced seating, the resulting axial force shifts the bullet 32 from an extended condition, as shown if FIGS. 5C and 11D, to a contracted condition (seated), as seen in FIGS. 5D and 11E. The bullet tail portion 39 is forced against the inward protrusions 52 and shifted closer to, against or just adjacent to the bottom wall portion 41 of the cup component 237, as shown in FIG. 14B (contracted condition). The side wall portion 35 is driven up the side of the bullet tail portion 39, over or against the camming surface 56, if included, and toward the bullet inward shoulder 80. As a result of the axial force of the firing or forced seating, the inward protrusions 52 are either sheared away from the side wall portion 35, broken up into pieces, folded outward or circumferentially or collapsed against the side wall portion 35. In some embodiments, the inward protrusions 52 are radially forced outward, such that the outer diameter of the side wall portion 35 increases, creating an obturation effect.

The frictional or gripping engagement of the side wall portion 35 and the obstructive placement and construction of any contraction inhibiting members, can be constructed and designed such that a threshold of axial force in combination with the frictional or gripping engagement force of the side wall portion (or the cup component) can be programmed according to desired use and application. As an example, the number, arrangement, inward extension, sloping orientation or material stiffness or resilience of the inward protrusions 52, or other protrusions disclosed herein, can be configured to preclude contraction during loading and allow contraction upon firing.

In embodiments such as show in 8C, 8F, and 8G, the protrusions will shear off upon firing with remnants at the base of the cup. Other configurations of the contraction inhibiting members are contemplated such as discrete collapsible inserts and webbing that spans the interior and that is ruptured for contraction.

In some embodiments, the inward protrusions 52 can include uppers surfaces 53 that are downwardly angled such that forced applied to the rearward closed end 45 of the cup assembly 34 when the bullet is seated in the barrel and a propellant is discharged can drive the bullet toward the rearward closed end 45 and thereby apply an outward axial force on the inward protrusions 52. As the side wall portion 35 of the cup component 37 comprises a radially deforming polymer component proximate to the inward protrusions 52, the outward axial force can cause the deformable side wall portion 35 to expand radially outward to engage the barrel. In some embodiments, the downward angle of the upper surfaces 53 can be a constant or varied downward slope.

In some embodiments, the cup component 37 can comprise circumferential axial scoring on the exterior of the cup component 37 at a deformable portion to provide even radial expansion of the cup component 37. Axial scoring 54 can facilitate even radial expansion of the deformable portions of the cup component 37.

Figure 8G:
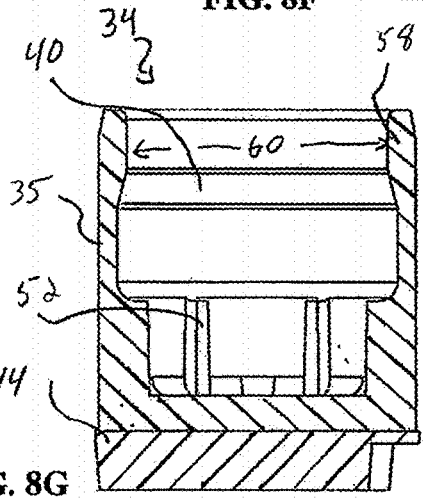
FIG. 8G is an axial cross-sectional view of the cup assembly of FIG. 8A.
Figure 8H:
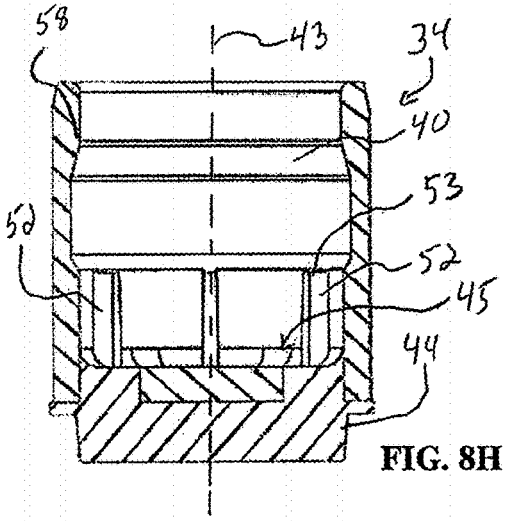
FIG. 8H is an axial cross-sectional view of the cup assembly of FIG. 8A rotated from the position of FIG. 8G.

As depicted in FIGS. 8F-8H, in some embodiments, the cup component 37 further comprises an internal thickened collar portion 58 defining a reduced inner diameter portion 60 at the open end 42 of the cup component 37 for engagement with the bullet camming surface 56 (see FIG. 7C). The cup assembly 34 is shaped to grip the tail portion 39 of the bullet 32 when the tail portion 39 is inserted.

In some embodiments, the cup component 37, including the inward protrusions 52, can comprise a polymer material including, but not limited to nylon, polyethylene and polypropylene. In certain aspects, the polymer material can be opaque or translucent. In another aspect, the polymer material can include a friction reducing additive or be formed of fluoropolymers. Generally the cup will be homogeneous such that all portions of the cup component 37 may be deformable, however, particular portions may have structure, a thin wall for example, or modifications, such as indentations or scoring, to enhance the deformability, particularly radial deformation. The cup component 37 is amenable to being injection molded and can be unitarily formed.

The tail component 44 of the cup assembly 34 may be molded with the rearward wall portion 41 of the cup component 37. As depicted in FIGS. 10A-10D, in an embodiment, tail component 44 can include a disc portion 61 having an upper surface 62 facing the cup component 37. The outer periphery of the disc portion 61 forms an edge 68. In some embodiments, the edge 68 has a diameter that is slightly larger than a diameter of cup component 37. In such a configuration, the edge 68 can engage barrel rifling and provide improved barrel fouling removing capabilities and perform a scraping, clearing, or cleaning function as it is delivered through the barrel.

The tail component can further comprise a foot portion 63 extending downward from the disc portion 61. The foot portion 63 can comprise an inner disc portion 67, parallel and adjacent the disc portion 61, and projections 66 radially extending from the inner disc portion. The projections 66 can be circumferentially spaced around the outer periphery of the inner disc portion 67. In some embodiments, the projections 66 radially extend short of edge 68 and in some embodiments flush with edge 68.

Figure 9A:
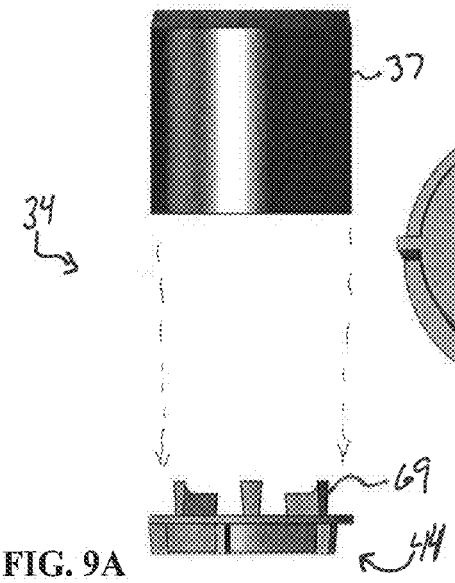
FIGS. 9A-9B are side elevation and rear perspective views of separated components of the cup assembly of FIG. 8A.
Figure 9B:
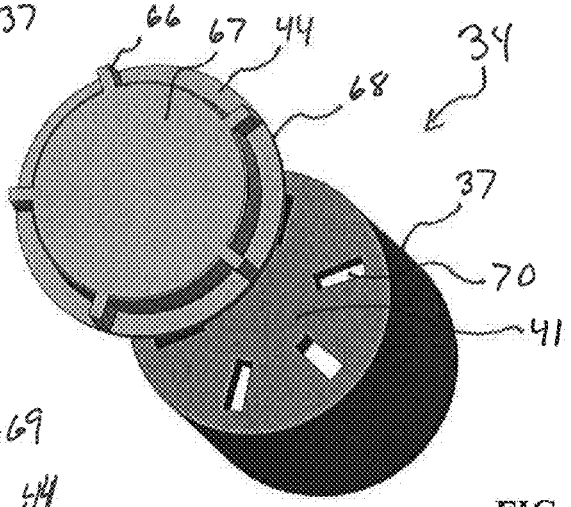
Figure 10A:
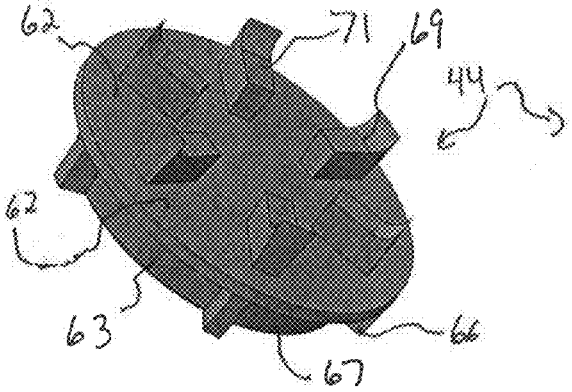
FIGS. 10A-10D are a front perspective view, a top plan view and two side elevation views, respectively, and show a tail component of a cup assembly according to an embodiment of the invention.
Figure 10B:
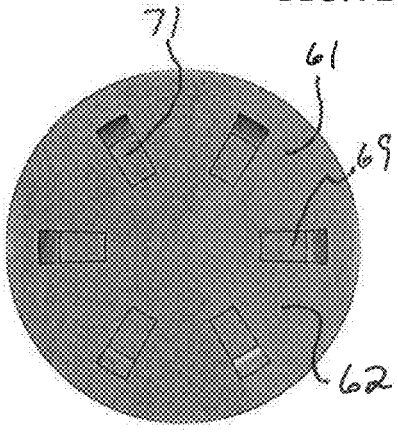
Figure 10C:
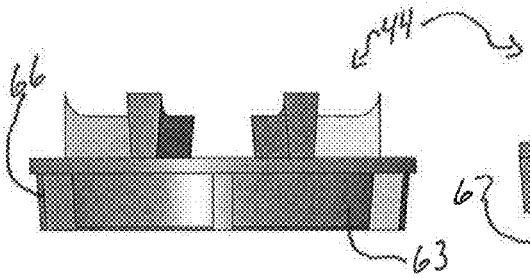
Figure 10D:
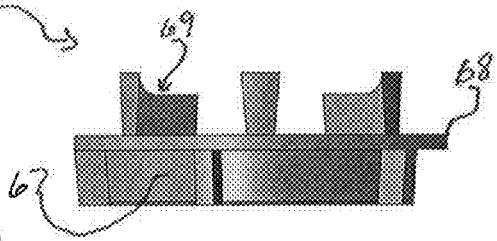

In some embodiments, the tail component 44 can comprise a plurality of posts 69 extending upward from the upper surface 62. The posts 69 are shaped and configured to align and fit into openings 70 in the bottom wall portion 41 of the cup component 37. FIGS. 9A-9B show the alinement of the posts 69 and the openings 70 and the assembly of the cup assembly 34. In some embodiments, the shape and height of the posts 69 and the thickness of the bottom wall portion 41 are such that, when inserted and assembled, the upper surfaces 71 of the posts 69 are flush with the inner surface of the bottom wall portion 41 and the side wall portion 35. This can be seen in FIGS. 8C, 8D and 8F.

In some embodiments, the cup assembly is manufactured using an overmolding process, wherein the cup component 37 is overmolded onto the tail component 44, or vice versa, to form a unitary part. Among other benefits, this aids in forming the cup assembly 34 such that the upper surfaces 71 of the posts 69 are flush with the inner surface of the bottom wall portion 41 and the side wall portion 35.

The method is advantageous in that it can reduced secondary operation, assembly and labor costs; eliminate the steps of fitting and bonding the cup component 37 and the tail component 44 together in the manufacturing process; improve component reliability; ensure proper alignment; prevents loosening and provide improved resistance to vibration and shock; improve part strength and structure; and enhance design flexibility, including using multi-material components.

The cup assembly 34 can also be assembled by separately forming the cup component 37 and the tail component 44 and assembling them as shown in FIGS. 9A-9B. The components can be held together via a friction fit or can be bonding together through suitable adhesives or welding.

The cup component 37 is amenable to being injection molded and can be unitarily formed. In an embodiment, the tail component 44 can comprise a relatively rigid or incompressible material. Examples of suitable materials include rigid polymers including, but not limited to glass-filled nylon. In some embodiments, the glass-filled nylon includes a mix of nylon polymer and glass particles or fibers. The mix can be preblended, i.e., masterbatched, prior to blending with the other ingredients of the polymeric blends of this invention. Or, the glass/nylon mix can be prepared in situ, i.e., the individual ingredients, including nylon and glass, can be added at the same time that the other ingredients of the polymeric blends are mixed. The nylon and glass particles or fibers are bonded or coupled to one another.

Non-limiting examples of suitable nylons include, but are not limited to, polypyrrolidone (nylon 4), polycaprolactam (nylon-6), polyheptolactam (nylon-7), polycapryllactam (nylon 8), polynonanolactam (nylon-9), polyundecanolactum (nylon-11), polylauryllactam (nylon 12), polyhexamethylene adipamide (nylon-6,6), polyhexamethylene azelamide (nylon-6,9), polyhexamethylene sebacamide (nylon-6,10), polyamide of hexamethylenediamine and n-dodecanedioic acid (nylon-6,12), polyamide of dodecamethylenediamine and n-dodecanedioic acid (nylon-12,12), polyhexamethylene isophthalamide (nylon-6, IP) and polyhexamethyleneterephthalamide (nylon-6, TP). Nylon copolymers may also be use, for example, as nylon-6-nylon-66 copolymer, nylon-6-nylon-i2 copolymer and the like. Nylon-12 is commercially available from Aldrich Chemical Company (Milwaukee, Wisc).

Unless specifically indicated or evident from the figures, elements, materials, methods of use and making, characteristics and features described in regard to embodiments addressed above equally apply to the following embodiments and components. Unless specifically indicated or evident from the figures, reference numerals with the same last two digits should be considered and treated alike.

Referring now to FIGS. 11A-12E, a further embodiment of a bullet assembly is shown. FIGS. 11A-11C show outer perspective and side views of the bullet assembly 130. FIG. 11D shows the bullet assembly 130 in its extended condition and FIG. 11E shows the bullet assembly in its contracted condition.

In the embodiment, bullet assembly 130 comprises a bullet 132 having a head portion 136 and a cup assembly 134, which can function as a base sabot. The cup assembly 134 can include a well cavity 140 configured to receive the tail portion 139 of the bullet 132. The bullet can be configured to receive a tip insert 150. FIG. 11C shows an illustration of the fitting arrangement of an embodiment of the cup assembly 134, the bullet 132 and the tip insert 150. The well cavity 140 can have differing shapes consistent with desired performance, upset characteristics and shape of tip insert. As an example, the embodiment shown in FIG. 5A, the cavity is conical and the present embodiment, the cavity includes a substantially flat bottom surface. In some embodiments, the bullet can be formed without a cavity.

FIGS. 11A-11D show an embodiment of the bullet 134. The bullet 132 comprises a forward tapered end configured as a tapered head portion 136, a cam surface 156 and a generally cylindrical tail portion 139 configured to be received in the cup assembly 134. The bullet well cavity 138, which can be optionally included, receives the tip insert 150 and can operate as a hollow point tip facilitating mushrooming of the bullet upon impact to increase the damage to the target caused by the bullet.

Referring to FIGS. 13A-13G, in some embodiments, the cup assembly 134 comprises a cup component 137 having a side wall portion 135 and a bottom wall 141 and a tail component 144, as discussed above. The side wall portion 135 can be generally tubular and axially aligned and comprises a radially deforming polymer component. The tail component 144 can be generally disc-like and is perpendicularly oriented relative to the axis 143 (also the axis of the bullet assembly 130) of the tubular side wall portion 135 (tail component also described above). The side wall portion 135, bottom wall 141 and in some embodiments the tail component 144 define the well cavity 140 having a forward open end 142 and a rearward closed end 145.

In some embodiments of the invention, the cup component 137 includes internal inward protrusions 152, as discussed above with regard to inward protrusions 52. The inward protrusions similarly can be positioned at the rearward closed end 145 of the well cavity that project and extend inward from the side wall portion 135. When the bullet 132 is inserted into the cup component 137, the bottom of the tail portion 139 of the bullet 132 is adjacent to or rests on upper surfaces 153 of the inward protrusions 152.

In some embodiments, the inward protrusions also project and extend upward from the bottom wall 141. In some embodiments, the inward protrusions project and extend upward from the bottom wall 141 and project and extend inward from the side wall portion 135. The inward protrusions can be integral with either or both the side wall portion 135 and the bottom wall 141. In some embodiments, the inward protrusions 152 are evenly distributed at the rearward closed end 145 around the axis 143 of the side wall portion 135.

Figure 13A:
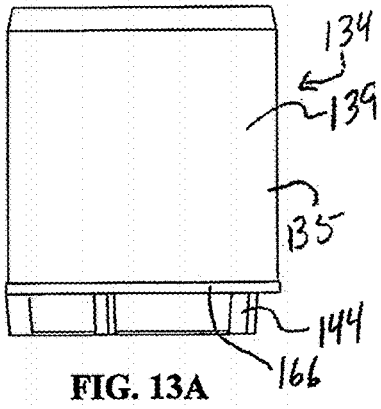
FIG. 13A is a front elevation view of the cup assembly of the projectile of FIG. 11A, according to an embodiment of the invention.
Figure 13B:
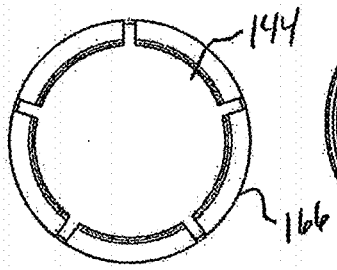
FIG. 13B is a bottom plan view of the cup assembly of FIG. 13A.
Figure 13C:
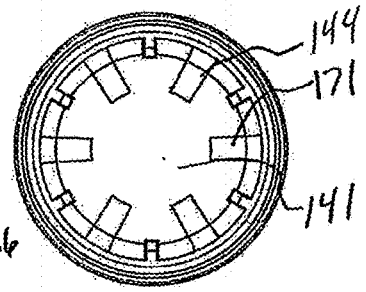
FIG. 13C is a top plan view of the cup assembly of FIG. 13A.
Figure 13D:
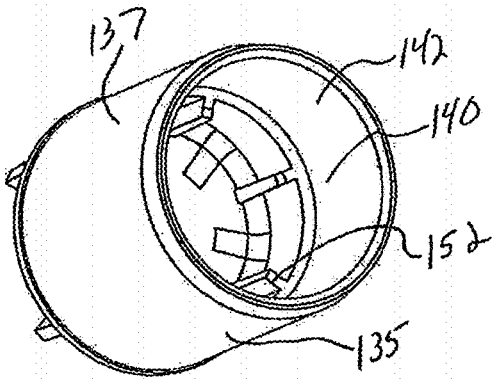
FIG. 13D is a front perspective view of the cup assembly of FIG. 13A.
Figure 13E:
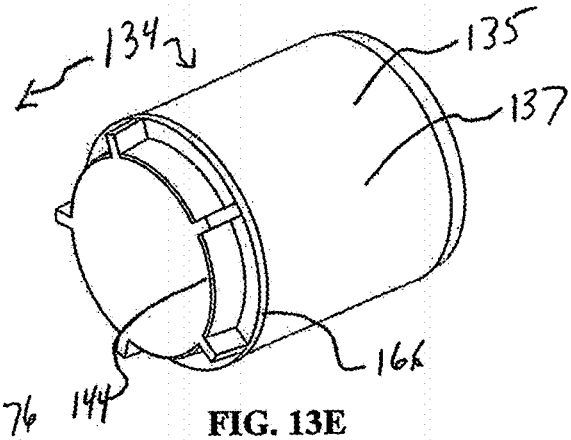
FIG. 13E is a rear perspective view of the cup assembly of FIG. 13A.
Figure 13F:
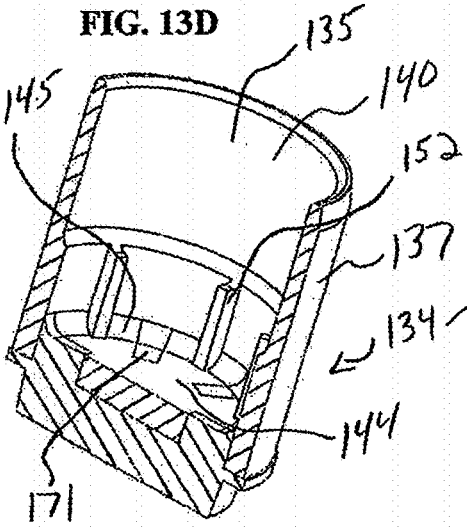
FIG. 13F is a front perspective cross-sectional view of the cup assembly of FIG. 13A.
Figure 13G:
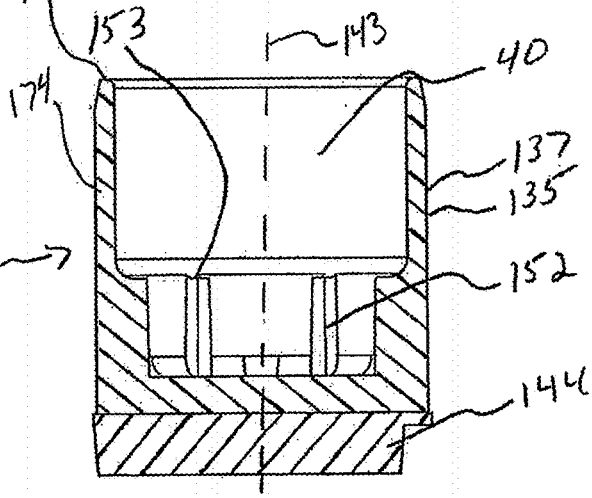
FIG. 13G is an axial cross-sectional view of the cup assembly of FIG. 13A.

As depicted in FIG. 13G, in some embodiments, the side wall portion 135 includes a wall thickness 174 that is substantially uniform from the inward protrusions 152 to the top of the cup component 137. In some embodiments, the wall thickness can thin to a terminating end 176 and in some embodiments can have a portion of increased thickness at the terminating end 176. The cup assembly 134 can be shaped to grip the tail portion 139 of the bullet 132 when the tail portion 139.

Embodiments of the cup assembly 134 and its tail component 144 and cup component 137, including inward protrusions 152, and configurations, arrangements, makeup and formation thereof, include those discussed above with regard to cup assembly 34 and its tail component 44 and cup component 37, including inward protrusions 52.

Figure 14A:
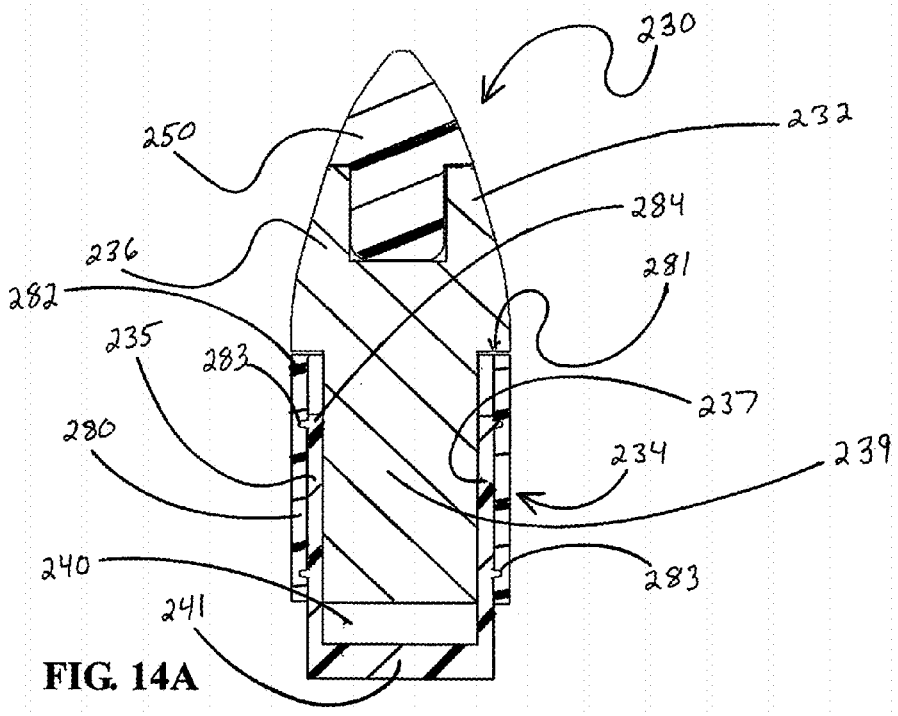
FIG. 14A is a cross-section view along the axis of a projectile according to an embodiment of the invention in an axial extended condition.
Figure 14B:
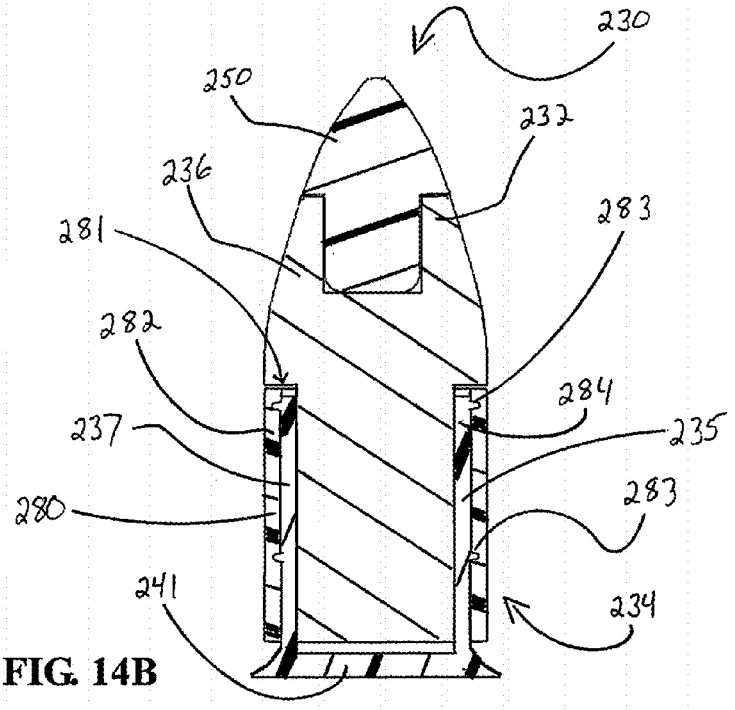
FIG. 14B is a cross-section view along the axis of the projectile of FIG. 14A in an axial contracted condition.

Referring to FIGS. 14A and 14B, in an embodiment of the invention, a bullet assembly 230 comprises a bullet 232 having a head portion 236, a recessed tail portion 239 and an inward shoulder 281 and a radially deforming cup assembly 234. The cup assembly 234 comprises an outer sleeve component 280 and a cup component 237 having a side wall 235 positioned inside the outer sleeve component 280 and a bottom wall 241. The outer sleeve component 280 and the side wall 235 are formed of polymer materials, which may be the same or different for each, with the proviso that they do not bond to one another during assembly or molding, for example in a two shot injection molding process or an overmolding process, and slide relative to one another. In some embodiments, the outer sleeve component is formed of stationary compliant material.

In use, portions of the outer sleeve component 280 and the side wall 235 slide relative to one another. The outer sleeve component 280 is assembled so as to remain stationary relative to the bullet 232 in use. In some embodiments, a forward end 282 of the outer sleeve component 280 can be secured to a surface of the inward shoulder 281. The side wall 235 of the cup component 237 is assembled to be axially movable relative to the outer sleeve component 280 and the bullet 232. In some embodiments, a forward end 284 of the side wall 235 is spaced from the inward shoulder 281, as shown in FIG. 14A (extended position).

The side wall 235 of the cup component 237 further can comprise an outer surface having one or more axial projections 283. Examples of axial projections include circumferential projections 283, individual insular projections or ring(s) of individual projections. Such projections can be integrally formed. The projections can engage the inner surface of the outer sleeve component 280 by friction fit or by being matingly received in corresponding female recess portions in the inner surface of the outer sleeve component 280. In some embodiments, the engagement mechanism can be arranged in a reverse manner, for example, the projections can be formed in the outer sleeve component 280.

Upon firing or forced seating, the resulting axial force overcomes a threshold counter force and shifts the bullet 232 from an extended condition to a contracted condition (seated), such that the bullet tail portion 239 is shifted closer to or just adjacent to the bottom wall 241 of the cup component 237, as shown in FIG. 14B (contracted condition). This results in the cup component 237 sliding forward inside the outer sleeve component 280 toward the inward shoulder 281.

The bottom wall 241 of the cup component 237 is of sufficient thickness and is formed of deformable polymer material such that, also upon axial force, it flattens and radially expands, resulting in a greater outer diameter. This produces an obturation effect or wedging against the inner surface or rifling of the barrel of the firearm, as shown in FIG. 14B. Also, during firing, the expanding propellant gases push against the expanded bottom wall, facilitating efficient launch of the bullet assembly.

Referring to FIGS. 15A and 15B, in an embodiment of the invention, a bullet assembly 330 comprises a bullet 332 having a head portion 336, a recessed tail portion 339 and an inward shoulder 381 and a radially deforming cup assembly 334. The cup assembly 334 comprises a cup component 347 having side wall 335 and a bottom wall 341. The side wall 335 includes weakened portions or points 333 that, under axial force on the side wall 335, induce or cause a folding or collapsing or the side wall 335 at said portions or points.

In FIGS. 15A and 15B, the weakened portions or points 333 are shown in the form of two circumferential inner grooves in the side wall 335. Examples of weakened portions or points can be in the form of scoring, thinning, cutting, creasing, hardening, or other mechanism that creates one or more hinge points 382 which collapse under sufficient axial force. The sleeve can comprise multiple weakened portions or points. The weakened portions or points 333 can comprise annular rings or rings of weakening of the side wall material.

The side wall 335 is assembled so as to remain substantially stationary relative to the bullet 332 in use. In some embodiments, a forward end 382 of the side wall 335 can be secured to a surface of the inward shoulder 381. In some embodiments, the outer sleeve component is formed of stationary compliant material.

Upon firing or forced seating, the resulting axial force shifts the bullet 332 in the cup assembly 334, causing the weakened portions 333 to buckle, fold, pinch or collapse under the columnar pressure at the hinge point 382, creating an obturation effect. The axial force shifts the bullet 332 from an extended condition to a contracted condition (seated), such that the bullet tail portion 339 is shifted closer to or just adjacent to the bottom wall 341 of the cup assembly 334, as shown in FIG. 15B (contracted condition).

Referring to FIGS. 16A and 16B, in an embodiment of the invention, a bullet assembly 430 comprises a bullet 432 having a head portion 436, a recessed tail portion 439 and an inward shoulder 481 and a radially deforming cup assembly 434. The cup assembly 434 comprises cup component 437 and a forward sleeve component 487 axially positioned substantially in-line and above the cup component 437.

The cup component 437 includes a bottom wall 441, a side wall 435, and a forward end 484 that is positioned adjacent to and partially inside a rearward end 489 of the forward sleeve component 487. The forward sleeve component 487 and the side wall 435 are formed of polymer materials, which may be the same or different for each, with the proviso that they do not bond to one another during assembly or molding, for example in a two shot injection molding process or an overmolding process, and slide relative to one another. In some embodiments, the forward sleeve component 487 is formed of stationary compliant material.

In use, portions of the forward sleeve component 487 and the side wall 435 slide relative to one another. The forward sleeve component 487 is assembled so as to substantially remain axially stationary relative to the bullet 432 in use. In some embodiments, a forward end 490 of the forward sleeve component 487 can be secured to a surface of the inward shoulder 481. The side wall 435 of the cup component 437 is assembled to be axially movable relative to the forward sleeve component 487 and the bullet 432. In some embodiments, a forward end 484 of the side wall 435 is spaced from the inward shoulder 481, as shown in FIG. 16A (extended position), and overlapped by the rearward end 489 of the forward sleeve component 487.

Upon firing or forced seating, the resulting axial force overcomes a threshold counter force and shifts the bullet 432 from an extended condition to a contracted condition (seated), such that the bullet tail portion 439 is shifted closer to or just adjacent to the bottom wall 441 of the cup component 437, as shown in FIG. 16B (contracted condition). This results in the cup component 437 sliding forward relative to the bullet 432. The forward end 484 slides up and under the forward sleeve component 487, causing the portion of the forward sleeve component 487 adjacent to its rearward end 489 to bulge or shift radially outward, creating an obturation effect 492.

Figure 17A:
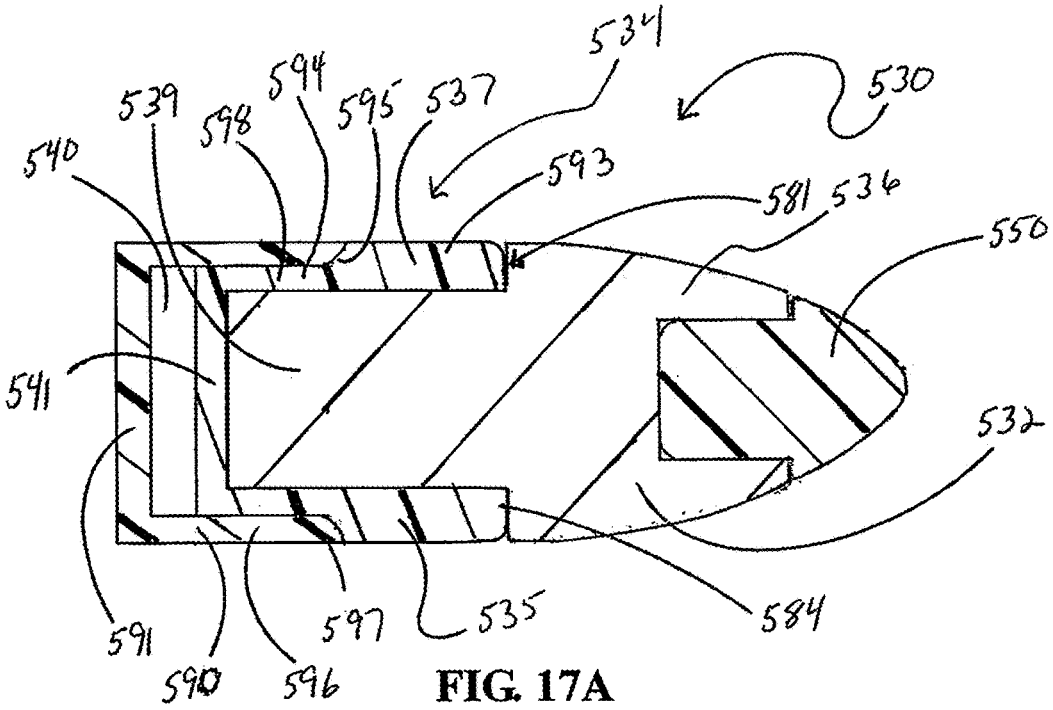
FIG. 17A is a cross-section view along the axis of a projectile according to an embodiment of the invention in an axial extended condition.
Figure 17B:
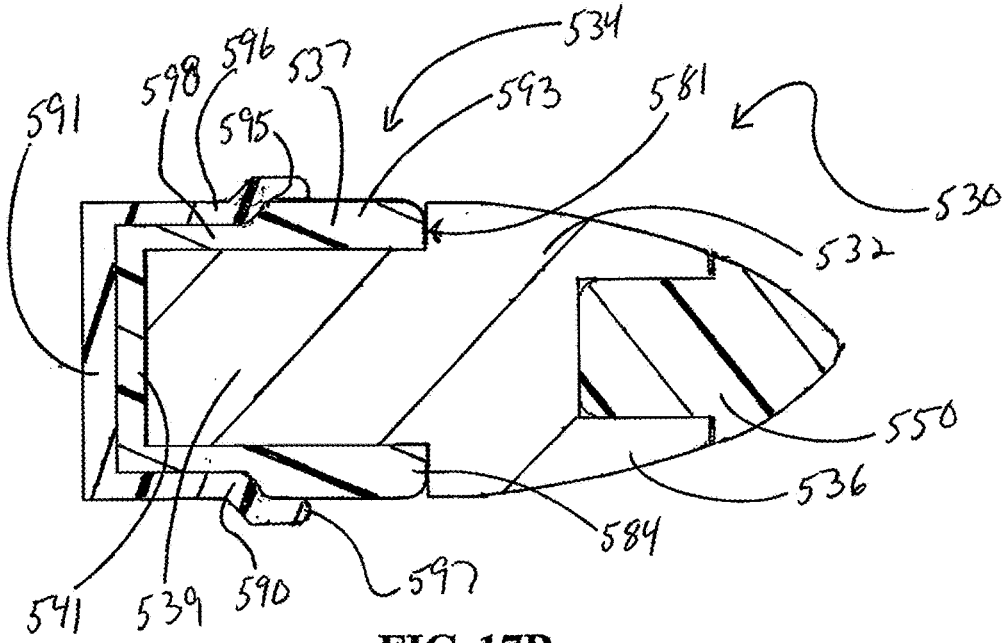
FIG. 17B is a cross-section view along the axis of the projectile of FIG. 17A in an axial contracted condition.

Referring to FIGS. 17A and 17B, in an embodiment of the invention, a bullet assembly 530 comprises a bullet 532 having a head portion 536, a recessed tail portion 539 and an inward shoulder 581 and a radially deforming cup assembly 534. The cup assembly 534 comprises an inner cup component 537 and an outer cup component 590 axially positioned partially rearward and partially below the inner cup component 537.

The inner cup component 537 includes a bottom wall 541 and a side wall 535 having a forward portion 593, a rearward portion 594, wherein the forward portion 593 has a greater thickness than that of the rearward portion 594, a forward end 584 that is positioned adjacent to and can be bonded to the inward shoulder 581 and a transition point 595, at which the forward portion 593 thickness transitions to the rearward portion 594 thickness.

The outer cup component 590 includes a bottom wall 591 and a side wall 596 being axially adjacent to the rearward portion 594 of the inner cup component 537 in the bullet assembly's extended position, as shown in FIG. 17A (extended position), and having a forward end 597 that is positioned adjacent to the transition point 595. The side wall 596 has a thickness that is less than that of the forward portion 593 of the inner cup component 537. In some embodiments, the thickness of the forward portion 593 of the inner cup component 537 is approximately the same as the combination of the thickness of the side wall 596 of the outer cup component 590 and the thickness of the rearward portion 594 of the inner cup component 537.

The inner cup component 537 and the outer cup component 590 are formed of polymer materials, which may be the same or different for each, with the proviso that they do not bond to one another during assembly or molding, for example in a two shot injection molding process or an overmolding process, and slide relative to one another. In some embodiments, side wall 596 of the outer cup component 590 is formed of stationary compliant material.

In use, portions of the inner cup component 537 and the side wall 596 of the outer cup component 590 slide relative to one another. The inner cup component 537 is assembled so as to substantially remain axially stationary relative to the bullet 532 in use. In some embodiments, the forward end 584 of the inner cup component 537 can be secured to a surface of the inward shoulder 581. The side wall 596 of the outer cup component 590 is assembled to be axially movable relative to the inner cup component 537 and the bullet 532.

Upon firing or forced seating, the resulting axial force overcomes a threshold counter force and shifts the bullet 532 from an extended condition to a contracted condition (seated), such that the bullet tail portion 539 is shifted closer to or just adjacent to the bottom wall 591 of the outer cup component 590, as shown in FIG. 17B (contracted condition). This results in the side wall 596 of the outer cup component 590 sliding forward relative to the bullet 532 and the inner cup component 537. The forward end 597 of the side wall 596 of the outer cup component 590 slides up and over the forward portion 593 of the inner cup component 537 at transition point 595. This causes the forward end 597 of the side wall 596 of the outer cup component 590 to bulge or shift radially outward, creating an obturation effect 592, as shown in FIG. 17B.

Figure 18A:
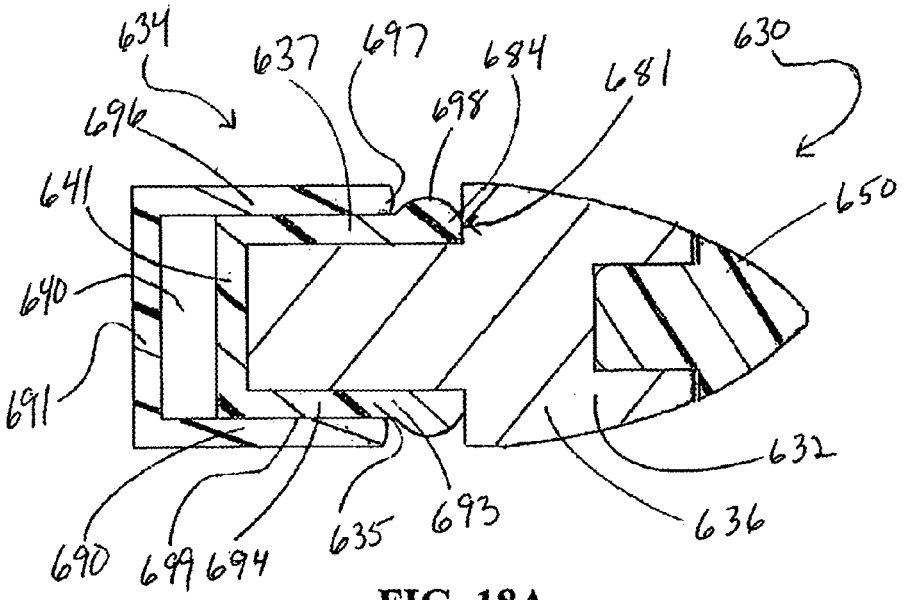
FIG. 18A is a cross-section view along the axis of a projectile according to an embodiment of the invention in an axial extended condition.
Figure 18B:
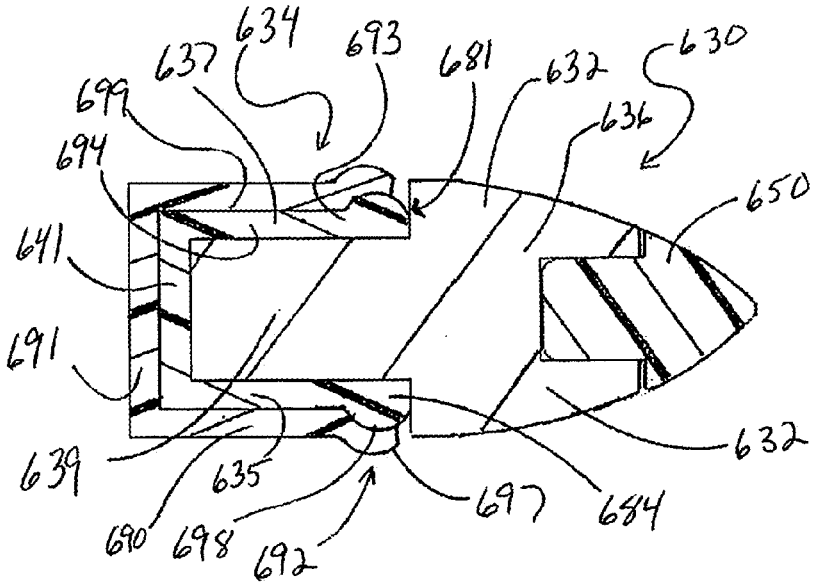
FIG. 18B is a cross-section view along the axis of the projectile of FIG. 18A in an axial contracted condition.

Referring to FIGS. 18A and 18B, in an embodiment of the invention, a bullet assembly 630 comprises a bullet 632 having a head portion 636, a recessed tail portion 639 and an inward shoulder 681 and a radially deforming cup assembly 634. The cup assembly 634 comprises an inner cup component 637 and an outer cup component 690 axially positioned partially rearward and portions partially below a portion of the inner cup component 637.

The inner cup component 637 includes a bottom wall 641 and a side wall 635 having a forward portion 693, a rearward portion 694, wherein the forward portion 693 comprises a portion of increased thickness 698 relative to the rearward portion 694, and a forward end 684 that is positioned adjacent to and can be bonded to the inward shoulder 681. In some embodiments, the portion of increased thickness can be in the form of a bulge 698 and can be at or adjacent to the forward end 684.

The outer cup component 690 includes a bottom wall 691 and a side wall 696 being axially adjacent to the rearward portion 694 of the inner cup component 637 in the bullet assembly's extended position, as shown in FIG. 18A (extended position), and having a forward end 697 that is positioned rearward of the portion of increased thickness 698. The rearward portion 694 has a thickness that is less than that of the portion of increased thickness 698 and can be flush with the inner surface 699 of the side wall 696, such that the portion of increased thickness 698 is radially outside of the inner surface 699.

The inner cup component 637 and the outer cup component 690 are formed of polymer materials, which may be the same or different for each, with the proviso that they do not bond to one another during assembly or molding, for example in a two shot injection molding process or an overmolding process, and slide relative to one another. In some embodiments, side wall 696 of the outer cup component 690 is formed of stationary compliant material.

In use, portions of the inner cup component 637 and the side wall 696 of the outer cup component 690 slide relative to one another. The inner cup component 637 is assembled so as to substantially remain axially stationary relative to the bullet 632 in use. In some embodiments, the forward end 684 of the inner cup component 637 can be secured to a surface of the inward shoulder 681. The side wall 696 of the outer cup component 690 is assembled to be axially movable relative to the inner cup component 637 and the bullet 632.

Upon firing or forced seating, the resulting axial force overcomes a threshold counter force and shifts the bullet 632 from an extended condition to a contracted condition (seated), such that the bullet tail portion 639 is shifted closer to or just adjacent to the bottom wall 691 of the outer cup component 690, as shown in FIG. 18B (contracted condition). This results in the side wall 696 of the outer cup component 690 sliding forward relative to the bullet 632 and the inner cup component 637. The forward end 697 of the side wall 696 of the outer cup component 690 slides up and over the portion of increased thickness 698 of the inner cup component 637. This causes the forward end 697 of the side wall 696 of the outer cup component 690 to bulge or shift radially outward, creating an obturation effect 692, as shown in FIG. 18B.

Figure 19A:
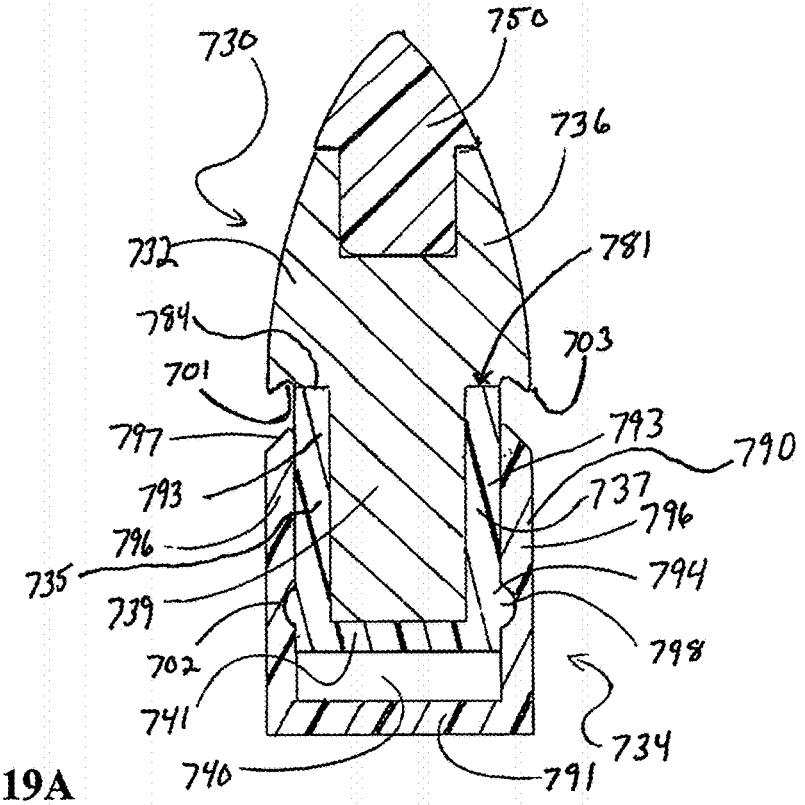
FIG. 19A is a cross-section view along the axis of a projectile according to an embodiment of the invention in an axial extended condition.
Figure 19B:
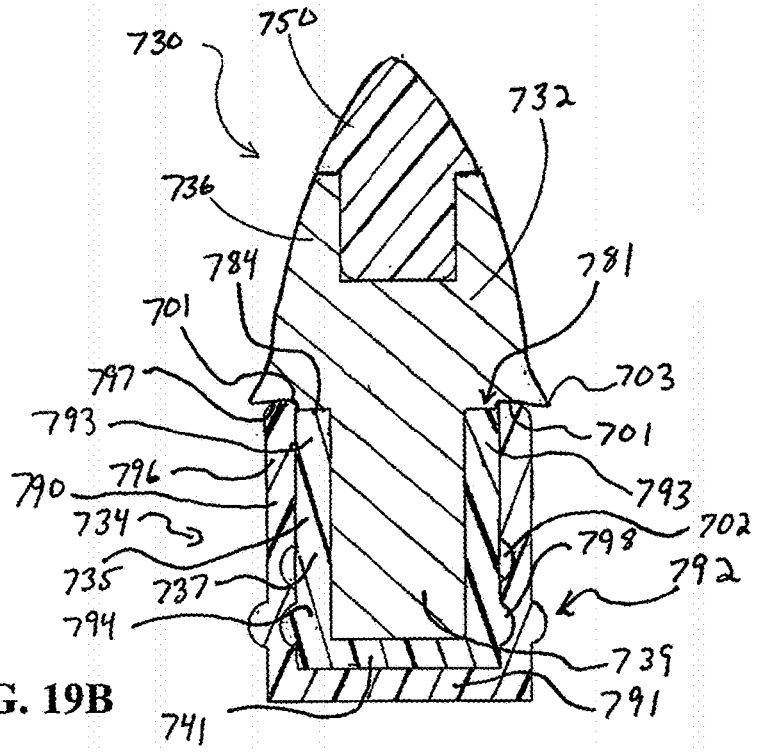
FIG. 19B is a cross-section view along the axis of the projectile of FIG. 19A in an axial contracted condition.

Referring to FIGS. 19A and 19B, in an embodiment of the invention, a bullet assembly 730 comprises a bullet 732 having a head portion 736, a recessed tail portion 739 and an inward shoulder 781 having a flare point 701 and a radially deforming cup assembly 734. The cup assembly 734 comprises an inner cup component 737 and an outer cup component 790 axially positioned outside and partially rearward the inner cup component 737.

The inner cup component 737 includes a bottom wall 741 and a side wall 735 having a forward portion 793, a rearward portion 794, and a forward end 784 that is positioned adjacent to and can be bonded to the inward shoulder 781.

The outer cup component 790 includes a bottom wall 791 and a side wall 796 being axially adjacent to the rearward portion 794 of the inner cup component 737 in the bullet assembly's extended position, as shown in FIG. 19A (extended position), and having a forward end 797 that is positioned rearward of, spaced from and slidably aligned with the flare point 701.

The bullet can be formed of suitable malleable material, such as lead, and have a flare point 701 positioned at the inner shoulder 781. A threshold of counter force upon the flare point 701 effectuates a flaring of the lower periphery 703 of the bullet head 736, as shown in FIG. 19B. The flare point 701 may be formed in any manner that translates applied force into a spreading of the lower periphery outward. Examples include modifying the inner shoulder 781 by imparting radial weakening in the bullet material, including, as examples, creating a circumferential channel or groove, scoring, cutting, creasing, hardening, prebending or other conventional manner to produce the effect. In some embodiments, the forward end 797 can be beveled radially inward so as to promote guidance of the outer cup component 790.

In some embodiments, the rearward portion 794 comprises a portion of increased thickness 798 relative to the forward portion 793. In some embodiments, the portion of increased thickness can be in the form of a bulge 798. The outer cup component 790 can have a female recess 702 that matingly corresponds to the portion of increased thickness 798. In some embodiments, the cup assembly 734 may comprise more than one of such mating features.

The inner cup component 737 and the outer cup component 790 are formed of polymer materials, which may be the same or different for each, with the proviso that they do not bond to one another during assembly or molding, for example in a two shot injection molding process or an overmolding process, and slide relative to one another. In some embodiments, side wall 796 of the outer cup component 790 is formed of stationary compliant material.

In use, portions of the inner cup component 737 and the side wall 796 of the outer cup component 790 slide relative to one another. The inner cup component 737 is assembled so as to substantially remain axially stationary relative to the bullet 732 in use. In some embodiments, the forward end 784 of the inner cup component 737 can be secured to a surface of the inward shoulder 781. The side wall 796 of the outer cup component 790 is assembled to be axially movable relative to the inner cup component 737 and the bullet 732.

Upon firing or forced seating, the resulting axial force overcomes a threshold counter force and shifts the bullet 732 from an extended condition to a contracted condition (seated), such that the bullet tail portion 739 is shifted closer to or just adjacent to the bottom wall 791 of the outer cup component 790, as shown in FIG. 19B (contracted condition). As the side wall 796 of the outer cup component 790 slides forward, the forward end 784 of the side wall 796 engages the flare point 701. The force of the forward movement of the outer cup component 790 imparts threshold counter force so as to effectuate a flaring of the lower periphery 703 of the head 736 of the bullet 732, creating an obturation effect.

Also, as the outer cup component slides forward, the portion of increased thickness 798 is removed from the corresponding female recess 702, thereby producing a radial protrusion or bulge in the outer surface of the cup assembly 734, creating an obturation effect 792, as shown in FIG. 19B.

Figure 20A:
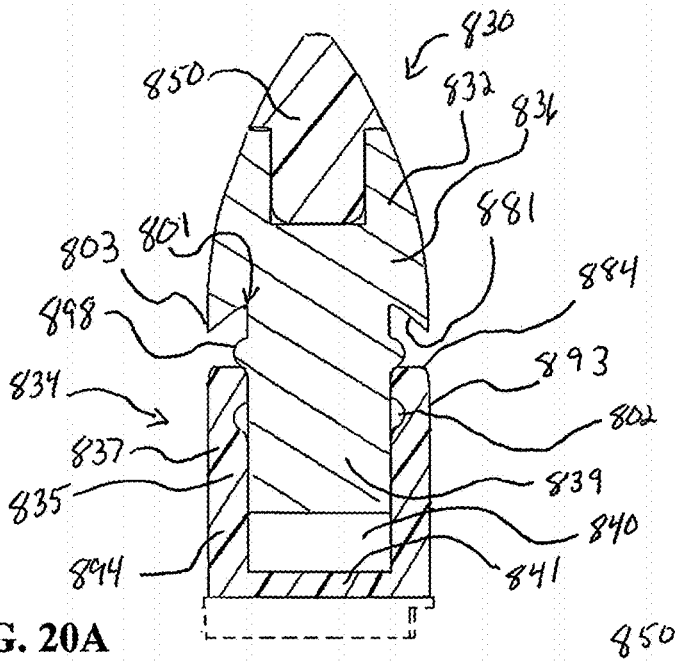
FIG. 20A is a cross-section view along the axis of a projectile according to an embodiment of the invention in an axial extended condition.
Figure 20B:
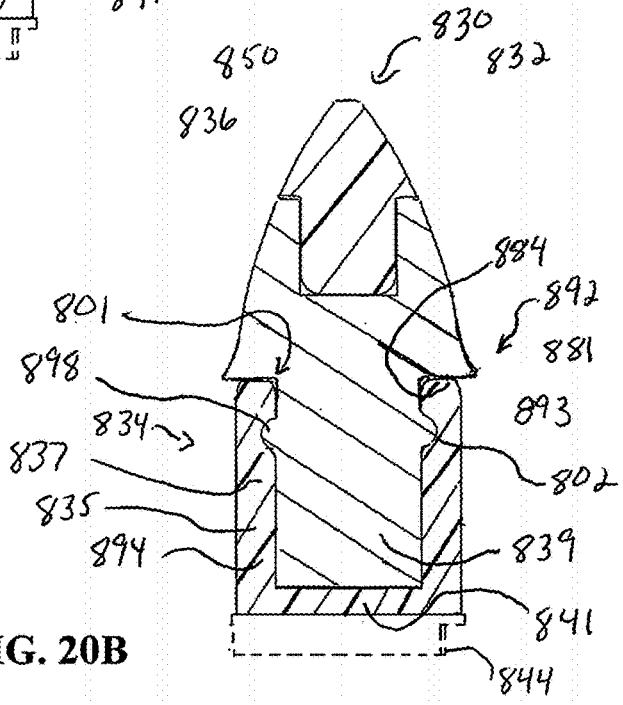
FIG. 20B is a cross-section view along the axis of the projectile of FIG. 20A in an axial contracted condition.

Referring to FIGS. 20A and 20B, in an embodiment of the invention, a bullet assembly 830 comprises a bullet 832 having a head portion 836, a recessed tail portion 839 and an inward shoulder 881 having a flare point 801 and a radially deforming cup assembly 834. The cup assembly 834 comprises a cup component 837 and a tail component 844. The tail component 844 can be as described above and is should be understood that all of the embodiments disclosed can include such a tail component.

The cup component 837 includes a bottom wall 841 and a side wall 835 having a forward portion 893, a rearward portion 894, and a forward end 884. The forward end 884 is axially spaced from the inward shoulder 881 and slidably aligned with the flare point 801 in the bullet assembly's extended position, as shown in FIG. 20A (extended position).

The inward shoulder 881 is angled rearward with flare point 801 positioned in the area of the apex of the angle. Upon a threshold of force by the side wall 835, a flaring of the lower periphery 803 of the bullet head 836 occurs, as shown in FIG. 20B. In some embodiments, the forward end 884 can be beveled radially inward so as to promote guidance of the cup component 837.

In some embodiments, the tail portion of the bullet 839 comprises a portion of increased thickness 898. In some embodiments, the portion of increased thickness can be in the form of a bulge 898. The cup component 837 can have a female recess 802 that matingly corresponds to the portion of increased thickness 898. In some embodiments, the bullet tail portion 839 and the cup assembly 834 may comprise more than one of such mating features. In some embodiments, the mating feature is reversed, with the cup component 837 having the increased thickness and the tail component having the recess.

The cup component 837 can be formed of polymer materials. In some embodiments, side wall 896 of the cup component 837 is formed of stationary compliant material. The side wall 835 of the cup component 837 is assembled to be axially movable relative to the tail portion 839 of the bullet 836.

Upon firing or forced seating, the resulting axial force overcomes a threshold counter force and shifts the bullet 832 from an extended condition to a contracted condition (seated), such that the bullet tail portion 839 is shifted closer to or just adjacent to the bottom wall 841 of the cup component 837, as shown in FIG. 20B (contracted condition). As the side wall 835 of the cup component 837 slides forward, the forward end 884 of the side wall 835 engages the shoulder 881. The force of the forward movement of the cup component 837 imparts threshold of forces so as to effectuate a flaring of the lower periphery 803 of the head 836 of the bullet 832, creating an obturation effect 892.

Figure 20C:
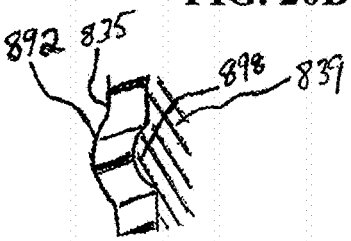
FIG. 20C is a cut-away partial view of the projectile of FIG. 20B in an axial contracted condition.

Also, as the outer cup component slides forward, the portion of increased thickness 898 moves down the inside of the side wall 835 and positions in the corresponding female recess 802, holding the tail portion 839 in place. In some embodiments, the side wall 835 does not have a recess, thereby producing a radial protrusion or bulge in the outer surface of the cup assembly 834, creating an obturation effect 892, as shown in FIG. 20C.

Figure 21A:
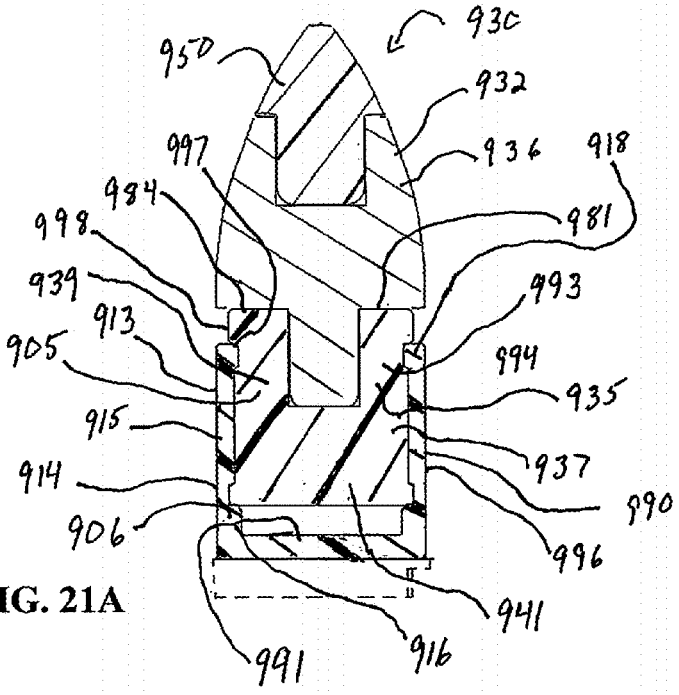
FIG. 21A is a cross-section view along the axis of a projectile according to an embodiment of the invention in an axial extended condition.
Figure 21B:
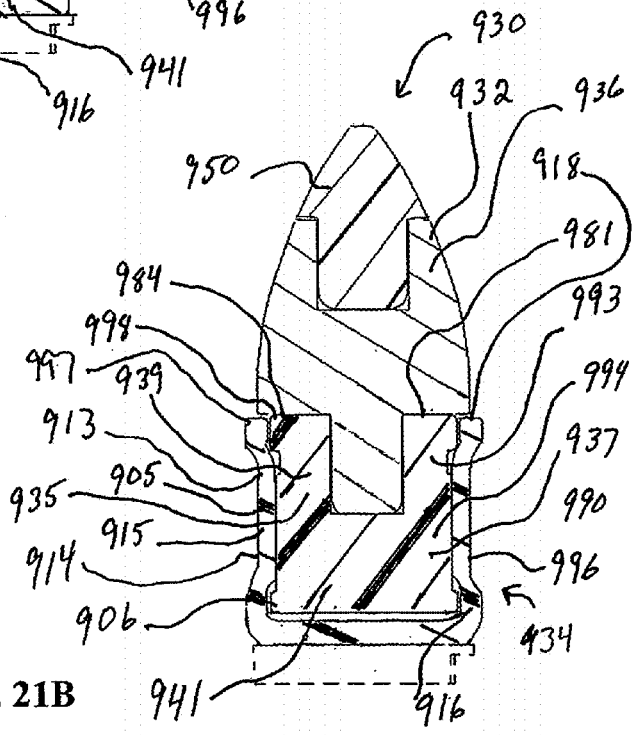
FIG. 21B is a cross-section view along the axis of the projectile of FIG. 21A in an axial contracted condition.

Referring to FIGS. 21A and 21B, in an embodiment of the invention, a bullet assembly 930 comprises a bullet 932 having a head portion 936, a recessed tail portion 939 and an inward shoulder 981 and a radially deforming cup assembly 934. The cup assembly 934 comprises an inner cup component 937 and an outer cup component 990 axially positioned partially rearward and portions partially below a portion of the inner cup component 937.

The inner cup component 937 includes a bottom wall 941 and a side wall 935 having a forward portion 993, a rearward portion 994, a middle portion 905, and a forward end 984 that is positioned adjacent to and can be bonded to the inward shoulder 981. The forward portion 993 and the rearward portion 994 each comprise a portion of increased thickness 998, 906, relative to the middle portion 905. In some embodiments, the portions of increased thickness can be in the form of a bulge 998. The forward one 998 can be at or adjacent to the forward end 984 and the rearward one 906 can be in the rearward portion 994.

The outer cup component 990 includes a bottom wall 991 and a side wall 996 being axially adjacent to the inner cup component 937 in the bullet assembly's extended position, as shown in FIG. 21A (extended position). The outer cup component 990 further comprises a forward portion 913, a rearward portion 914, a middle portion 915, and a forward end 997 that is positioned rearward of the portion of increased thickness 998. The forward portion 993 and the rearward portion 994 each comprise a portion of increased thickness 918, 916, relative to the middle portion 915. In some embodiments, the portions of increased thickness can be in the form of a bulge 998 and there can be a gap between the two side walls. The forward one 998 can be at or adjacent to the forward end 984 and the rearward one 906 can be in the rearward portion 994.

The inner cup component 937 and the outer cup component 990 are formed of polymer materials, which may be the same or different for each, with the proviso that they do not bond to one another during assembly or molding, for example in a two shot injection molding process or an overmolding process, and slide relative to one another. In some embodiments, side wall 996 of the outer cup component 990 is formed of stationary compliant material.

In use, portions of the inner cup component 937 and the side wall 996 of the outer cup component 990 slide relative to one another. The inner cup component 937 is assembled so as to substantially remain axially stationary relative to the bullet 932 in use. In some embodiments, the forward end 984 of the inner cup component 937 can be secured to a surface of the inward shoulder 981. The side wall 996 of the outer cup component 990 is assembled to be axially movable relative to the inner cup component 937 and the bullet 932.

Upon firing or forced seating, the resulting axial force overcomes a threshold counter force and shifts the bullet 932 from an extended condition to a contracted condition (seated), such that the bullet tail portion 939 is shifted closer to or just adjacent to the bottom wall 991 of the outer cup component 990, as shown in FIG. 21B (contracted condition). This results in the side wall 996 of the outer cup component 990 sliding forward relative to the bullet 932 and the inner cup component 937.

In the contraction of the bullet assembly 930, the forward end 997 of the side wall 996 of the outer cup component 990 slides up and over the portion of increased thickness 998 of the inner cup component 937. This causes the forward end 997 of the side wall 996 of the outer cup component 990 to bulge or shift radially outward, creating an obturation effect 992. Likewise, the reward end 994 of the side wall 935 of the inner cup component 937 slides over the portion of increased thickness 916 of the outer cup component 990. This causes the rearward end 914 of the side wall 996 of the outer cup component 990 to bulge or shift radially outward. As such, in the contracted condition as shown in FIG. 21B, the portions of increased thickness 998, 996, of the inner cup component 937 engage with the portions of increased thickness 918, 916, of the outer cup component 990, creating obturation effects 992.

Figure 22A:
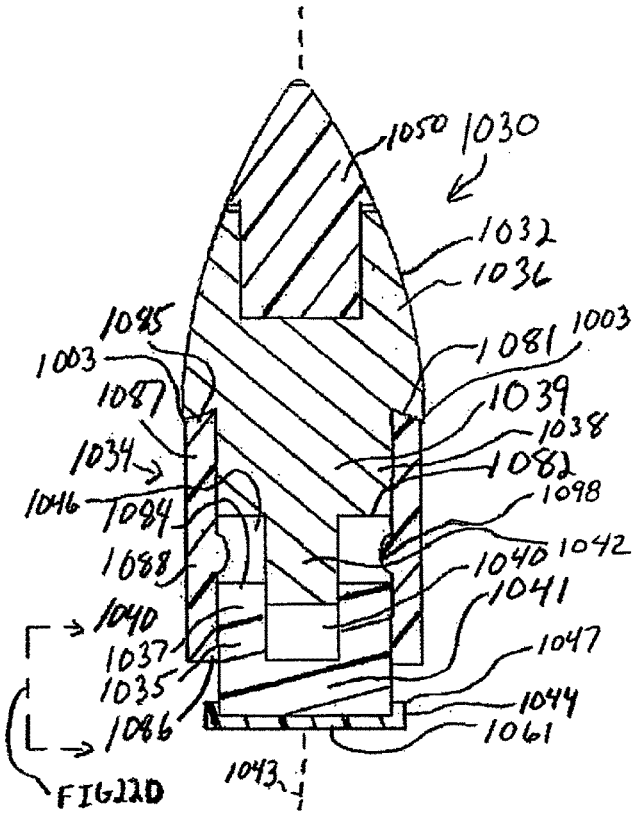
FIG. 22A is a cross-section view along the axis of a projectile according to an embodiment of the invention in an axial extended condition.
Figure 22B:
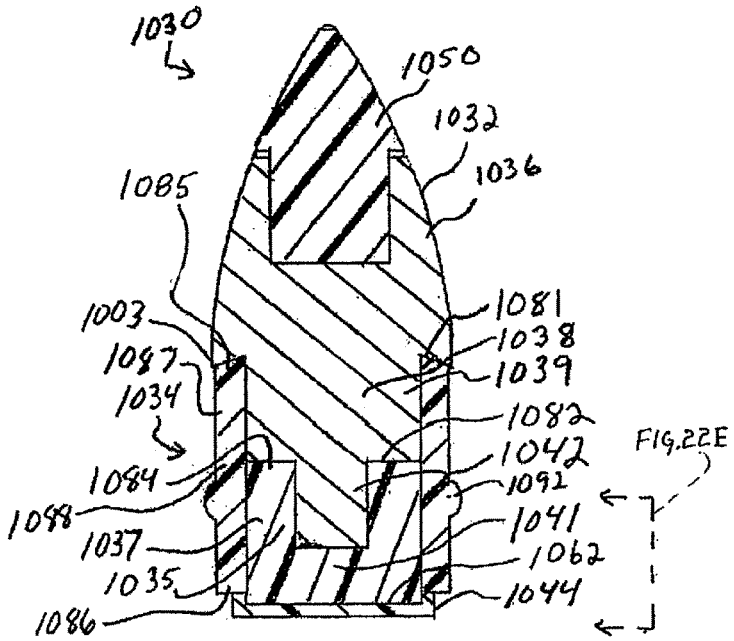
FIG. 22B is a cross-section view along the axis of the projectile of FIG. 22A in an axial contracted condition.

Referring to FIGS. 22A and 22B, in an embodiment of the invention, a bullet assembly 1030 comprises a bullet 1032 and a radially deforming cup assembly 1034. FIG. 22A shows the bullet assembly 1030 in its extended condition and FIG. 22B shows it in its contracted condition.

The bullet 1032 comprises a head portion 1036, which includes a lower periphery 1003 and can include a well cavity 1083 shaped to receive a tip insert 1050, and a recessed tail portion 1039 extending reward from the head portion 1036 at a first inward shoulder 1081. In some embodiments, the first inward shoulder can be angled rearwardly and form an acute angle (with respect to a plane perpendicular to the axis) with the recessed tail portion 1039.

The recessed tail portion 1039 comprises a first recessed portion 1038 and a second recessed portion 1042 extending reward from the first recessed portion 1038 at a second inward shoulder 1082. The second recessed portion 1042 has a radial diameter that is less than the radial diameter of the first recessed portion 1038.

The cup assembly 1034 can comprises cup component 1037, a forward sleeve component 1087 and a tail component 1044.

The forward sleeve component 1087 can be positioned radially outside and around the cup component 1037 and the first recessed tail portion 1039 and axially substantially in-line with the first inward shoulder 1081. The forward sleeve component 1087 comprises a forward end 1085, which can be positioned adjacent to the first inward shoulder 1081, a rearward end 1086 and a middle portion 1088 between the forward end 1085 and the rearward end 1086. The middle portion 1088 of the forward sleeve component 1087 can further have a portion of increased thickness 1098 projecting radially inward. The portion 1098 can be positioned reward of the first inward shoulder 1081. In some embodiments, the portion of increased thickness 1098 can be in the form of a bulge.

The cup component 1037 includes a bottom wall 1041, a side wall 1035, and a forward end 1084. The forward end 1084 is positioned axially in-line with and, in the extended condition, spaced from the second inward shoulder 1082, rearward of the portion of increased thickness 1042. In the extended condition, there is a first cavity 1046 formed between the first inward shoulder 1082 and the forward end 1084 of the cup component 1037 and a second cavity 1040 defined by the side wall 1035 of the cup component. The second cavity 1040 is axially aligned with and is shaped to receive the second recessed portion 1042 of the tail portion 1039.

Figure 22C:
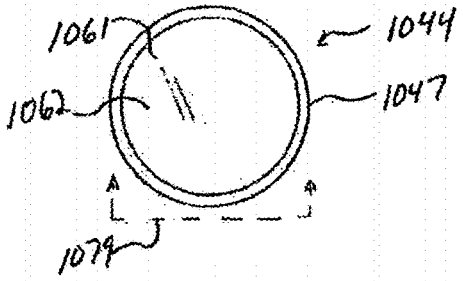
FIG. 22C is a top plan view of a tail component of the projectile of FIG. 22A.

The tail component 1044, also seen in FIG. 22C, can be generally disc-like and is perpendicularly oriented relative to the axis 1043 of the bullet assembly 1030. The tail component 1044 can comprise a disc portion 1061 having and upper surface 62 facing the cup component 1037. The outer periphery of the disc portion 1061 forms an annular lip 1047 axially extending in the forward direction, which in some embodiments can engage the sleeve upon firing and contraction.

In embodiments, the tail component 1044 has an outer diameter 1079 which is less than that of the lower periphery 1003 of the bullet head 1036 whereby the tail component will not engage the barrel or engage material built-up on the barrel during loading. Such a configuration allows a lesser contraction force to effect contraction. In manufacturing, the cup component 1037 can be overmolded onto the tail component 1044 or otherwise be a unitary part of it.

Figure 22D:
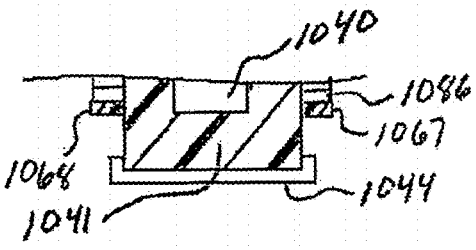
FIG. 22D is a cut-away partial view of an embodiment of the projectile of FIG. 22A in an axial extended condition.
Figure 22E:
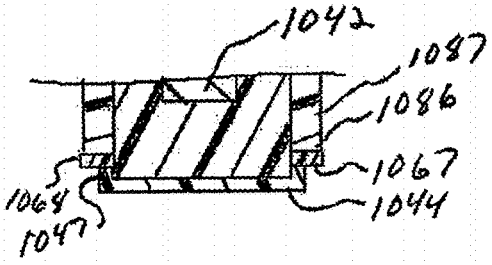
FIG. 22E is a cut-away partial view of an embodiment of the projectile of FIG. 22B in an axial contracted condition.
Figure 22F:
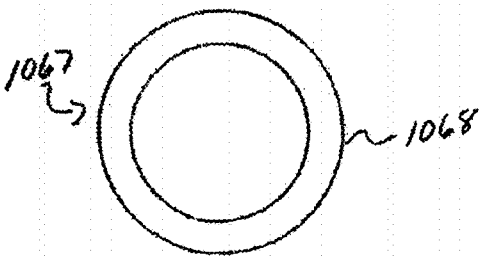
FIG. 22F is a top plan view of a ring in an embodiment of a forward sleeve component according to an embodiment of the invention.

FIGS. 22D and 22E show an embodiment of the lower portion of the bullet assembly 1030 in its extended condition (FIG. 22D) and its contracted condition (22E). As shown therein, in some embodiments, the forward sleeve component 1087 can further comprise a washer-shaped ring 1067 affixed to the rearward end 1086 and positioned around the cup component 1037. The ring 1067, also seen in FIG. 22F, includes an outer edge 1068. As shown in FIG. 22E, when the bullet assembly 1030 is in its contracted condition, the ring 1067 engage the annular lip 1047 of the tail component 1044. In some embodiments, the edge 1068 can provide improved barrel fouling removing capabilities and perform a scraping, clearing, or cleaning function as it moves through the barrel.

The forward sleeve component 1087 and the cup component 1037 are formed of polymer materials, which may be the same or different for each, with the proviso that they do not bond to one another during assembly or molding, for example in a two shot injection molding process or an overmolding process, and slide relative to one another. In some embodiments, the forward sleeve component 1087 is formed of stationary compliant material.

The side wall 1035 of the cup component 1037 is assembled to be axially movable relative to and slide between the forward sleeve component 1087 and the bullet 1032. In some embodiments, the forward end 1085 of the forward sleeve component 1087 can be adjacent to and can be secured to a surface of the first inward shoulder 1081. In some embodiments, in the extended condition (FIG. 22A), the forward end 1084 of the side wall 1035 is spaced from the second inward shoulder 1082, and overlapped by a rearward portion of the forward sleeve component 1087.

Upon firing or forced seating, the resulting axial force overcomes a threshold counter force and force shifts the bullet 1032 from an extended condition to a contracted condition (seated), such that the bullet tail portion 1039 is shifted closer to adjacent to the bottom wall 1041 of the cup component 1037, as shown in FIG. 22B (contracted condition). This results in the cup component 1037 sliding forward relative to and between the bullet 1032 and the forward sleeve component 1087. The forward end 1084 of the side wall 1035 is drawn to the second inward shoulder 1082 and the second recessed portion 1042 of the tail portion 1039 inserts into the cavity 1040 of the cup component 1034 (as seen in FIG. 22B).

In embodiments where the forward sleeve component comprises a portion of increased thickness 1098, the sliding of the side wall 1035 between the portion of increased thickness 1098 and the second recessed portion 1040 causes an outward bulging or radial outward projection 1092 in the forward sleeve component 1087, creating an obturation surface 1092.

In some embodiments, the difference between the length of the forward sleeve component 1087 and the distance between the first inward shoulder 1081 at the lower periphery 1003 of the bullet head 1036 and the annular lip 1047 of the tail component 1044 is less that the lesser of the axial lengths of the first 1046 and second 1040 cavities. In such embodiments, the contraction of the bullet assembly 1030, as seen if FIGS. 22B, 22E, causes the rearward end 1086 of the forward sleeve component 1087 to engage the tail component 1044 (in some embodiments the annular lip 1047), driving the forward sleeve component 1087 forward relative to the bullet tail portion 1039. This further causes the forward end 1085 of the forward sleeve component to engage and apply force to the first inward shoulder 1081.

Figure 22G:
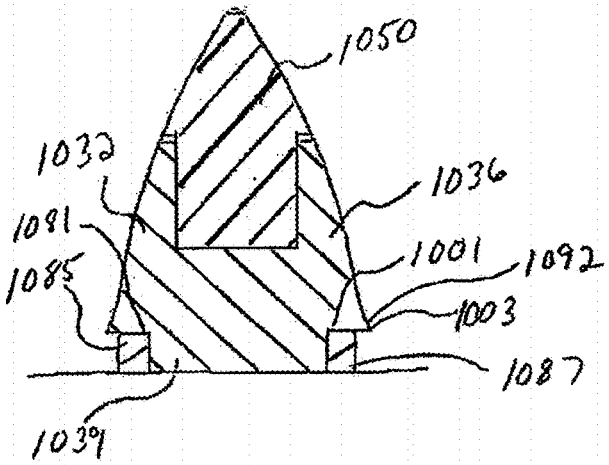
FIG. 22G is a cut-away partial view of an embodiment of the projectile of FIG. 22B in an axial contracted condition.

In such embodiments where the contraction causes the forward end 1085 of the forward sleeve component 1087 to engage and apply force to the first inward shoulder 1081, the bullet can be formed of suitable malleable material, such as lead, and have a flare point 1001. As seen in FIG. 22G, the flare point 1001 is a position of the first inner shoulder 1081, which can be downwardly angled to receive the forward end 1085 of the sleeve component 1087. The force of the forward sleeve component 1087 effectuates a flaring of the lower periphery 1003 of the bullet head 1036, as shown in FIG. 22G, creating an obturation surface 1092. The flare point 701, as described above, may be formed in any manner that translates applied force into a spreading of the lower periphery 1003 outward. In some embodiments, the forward end 1085 can be beveled radially inward, that is, undercut, so as to promote guidance into the first shoulder 1081.

Figure 23A:
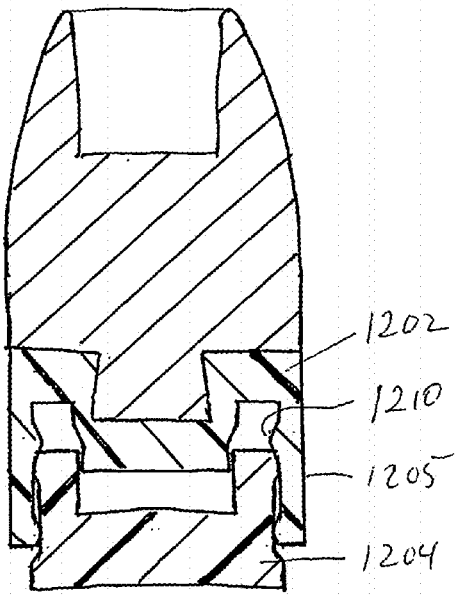
FIG. 23A is a cross-sectional view of another embodiment of a bullet assembly in a extended position.
Figure 23C:
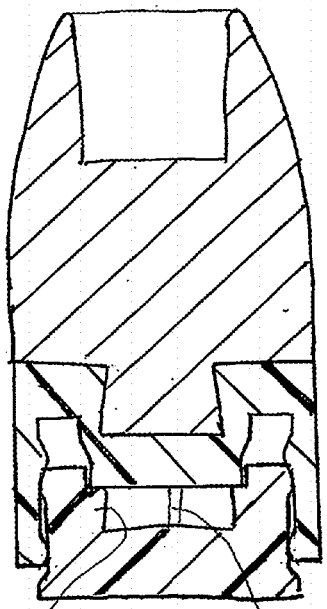
FIG. 23C is a cross sectional view of the bullet of FIG. 23A with contraction inhibiting posts.
Figure 23B:
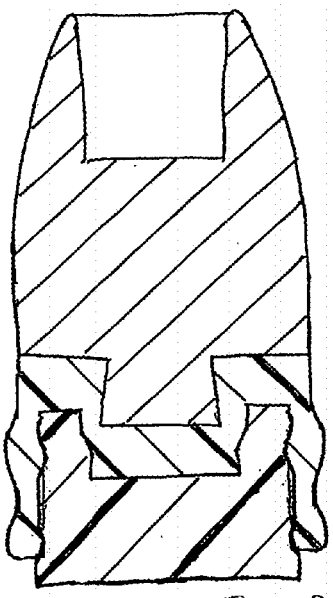
FIG. 23B is a cross-sectional view of the embodiment of the bullet of FIG. 23A in a contracted mode.

Referring to FIGS. 23A and 23B, another embodiment of a bullet assembly 1200, with a bullet 1201 and a cup assembly 1203. The cup assembly has two polymer components 1202, 1204 are axially slidable with respect to one another. The outwardly exposed component 1202 has a sleeve portion 1205 and is deformable radially outward upon insertion of the end cap 1204 as the assembly contracts to the contracted position. Annular protrusions can operate as detents to maintain the cup assembly and bullet assembly in the contracted position. Referring to FIG. 23C, posts 1220 or other contraction inhibiting members may be positioned to inhibit contraction, until the members are sheared off, or otherwise deformed, The above illustrated embodiments are shown in the figures with a bullet well cavity and instances without a tip insert. Embodiments of the present invention do include such embodiments with and without a bullet well cavity and with or without a tip insert.

In some embodiments, the components of the above bullet assemblies are assembled using an overmolding process. In some embodiments, the components are formed of dissimilar polymers in such a combination that the dissimilar polymer materials separated upon firing or forced seating.

A method of manufacturing a bullet assembly is included comprising providing a bullet having a frustotapered head portion and a cylindrical tail portion. The method comprises forming a cup assembly in which the cylindrical tail portion is inserted and which can function as a sabot. The cup assembly can comprise a first and second component, each formed of different polymers. In some embodiments, the first component is a cup formed of deformable polymer material and the second component is a tail portion formed of a rigid polymer material. The first and second components are in some embodiments separately form and in some embodiments the cup assembly is formed and assembled by an overmolding process. In some embodiments, internal inward protrusions are formed in the first component and are positioned rearward of the bullet in the bullet assembly.

In an embodiment, a method of manufacturing a bullet assembly comprising providing a bullet having a frustotapered head portion and a cylindrical tail portion. The method comprises over-molding a first polymer and a second polymer, different from the first, wherein the first and second polymer form first and second components that are slideably situated relative to each other and form a cup assembly of the bullet assembly. In some embodiments, the bullet can define an axial well cavity. The method also can comprise inserting the tail portion of a tip insert into the well cavity, wherein a tip insert comprises a tapered head portion that aligns with frustotapered head portion to provide an aerodynamic body.

In application, a method of loading a bullet assembly 30 into a muzzleloader 22, according to an embodiment of the present invention, comprises providing a bullet having a tail portion positioned within a well cavity of a cup assembly, wherein the tail portion is moveable within the well cavity. The method further comprises loading the bullet assembly into the muzzle 24 of the barrel 22. As the bullet assembly is pushed down the barrel and seated or upon firing, an edge or bulge of the bullet assembly is radially extended or exposed and can cut through fouling that has built up inside barrel, pushing the barrel fouling.

The bullet assembly 30 is loaded by positioning the bullet assembly 30 in the muzzle 24 of the barrel 22 and pushing it or ramming it down the barrel 22 with the ramrod until seated against a propellant charge 28 in the breech end 26 of the barrel 22. In an embodiment, the outer diameter of the cup assembly approximates the inner diameter of the lands of the barrel rifling such that the bullet assembly 30 can be loaded down the barrel 22 with minimal friction between the bullet 30 and the barrel 22. Upon seating against the propellant charge 28, in one embodiment, continued axial force can be applied to the bullet assembly 30 with the ramrod or is applied upon firing to move the tail portion 39 into the contracted condition and radially expanding the cup assembly 34 to engage the barrel 22.

In embodiments of the invention, an obturation mechanism comprises two or more parts that move axially with respect to one another and with at least one cam surface to cause radial expansion of the outer of the two components.

The components may have a detent to retain the two or more parts in a contracted position.

"Move axially" or "slide axially" when used herein with respect to two components means that the entire length of one component moves with respect to the other referenced component. Although one end may not need to move as much as an opposite end. In embodiments herein the axial movement is at least 0.10 inches. In other embodiments the axial movement is 0.15 inches. In other embodiments, the axial movement is 0.20 inches. In other embodiments, 0.30 inches.

In some embodiment, in operation, a bullet assembly made in accordance with the present disclosure is loaded into the muzzle 24 of the barrel 22. An axial force is applied to the bullet assembly with a ramrod to overcome the friction between the bullet assembly and the barrel 22. In some embodiments, the diameter of the bullet assembly in its extended state is less than the inner diameter of the barrel does not need significant axial force to allow the bullet assembly to slide down the barrel 22. Upon seating of the bullet assembly at the breech end of the 26 of the barrel 22, in embodiments that incorporate an obturation mechanism, that is two or more parts that move axially with respect to one another and with cam surfaces to cause radial expansion of the outer component, sufficient axial force can be applied to the tip of the bullet to exceed the axial force threshold of the obturation mechanism to move the bullet into a contracted condition. In some embodiments, the bullet assembly can be inserted and loaded without moving the bullet into the contracted condition and the bullet is moved into the contracted condition as a result of firing, which triggers the obturation mechanism and effect, causing radially expansion of a portion of the cup assembly, which can engage the rifling of barrel. In this embodiment, the bullet and cup are configured to resist compression until a threshold of axial force is applied.

Examples of materials for the polymer components and sleeves, include, but are not limited to, polymer material comprising nylon, polyethylene, polypropylene and suitable elastomeric materials. In certain aspects, the polymer material can be opaque or translucent. In another aspect, the polymer material can include a friction reducing additive or be formed of fluoropolymers.

According to aspects of the invention, the bullet body may comprises lead, aluminum, any suitable metallic and lead-free material, a metallic/polymer composition or a polymer based material. In some aspects, the bullet body may be jacketed with suitable materials, including copper and any other suitable jacket material.

The bullet assembly, in use, rides on the lands of the rifled barrel 22 and the polymer obturation portion or portions, when radially extended, can fill and seal the grooves of the rifled barrel preventing propellant gas leakage. Better transmission of spin to the projectile provides better dynamic stability and results in better accuracy. Energy generated by the propellant is better transmitted to the projectile and not allowed to bleed past the bullet.

In some embodiments, the tail portion of the bullet fits tightly into the cavity of the cup assembly, but remains removable by hand. In another embodiment, tail portion requires removal from the cavity using a hand tool. The separability feature provides additional flexibility that may be advantageous in the field. In an embodiment, projectile may be fired without the cup assembly; in another embodiment, the cup assembly may be removably attached and fired. Depending on the shooter's needs, projectile may be used with and without the cup assembly.

The patents, patent applications and patent publications referenced herein in all sections of this application, including the following, are herein incorporated by references in their entirety for all purposes. The methods, terms, tools, materials and teachings disclosed therein are herein incorporated only to the extent that they complement or expand the understanding and scope of the embodiments and claims of the presently disclosed invention and do not contradict or are inconsistent with such understanding and scope. Aspects of the instant application will be suitable for incorporation in known mechanisms. Any incorporation by reference of documents is limited such that no subject matter is incorporated that is contrary to the explicit disclosure herein: U.S. patent application Ser. No. 14/040,636, filed Sep. 28, 2013; U.S. patent application Ser. No. 14/041,951, filed Sep. 30, 2013; U.S. Design patent application No. 29/468434, filed Sep. 30, 2013; U.S. Patent Publication No. 20140130699, filed Sep. 30, 2013; and U.S. Patent Publication No. 20140090284, filed Sep. 30, 2013.

While the invention is amenable to various modifications and alternative forms, specifics thereof have been depicted by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A bullet assembly for a muzzleloader, the bullet assembly comprising a bullet and a cup assembly, the bullet having a forward tapered end and a rearward tail portion, the tail portion having a recessed portion;

the cup assembly being axially slidingly engaged on the tail portion of the bullet between a extended position and a contracted position, the cup assembly comprising a cup component having a tubular side wall having an inner surface, an outer surface and an axis and defining an open cavity that receives the tail portion of the bullet at an open end, the cup assembly having a bottom wall having an inner surface and an outer surface and defining a closed end, the cup component comprising a plurality of contraction inhibiting members positioned to interfere with contraction between the extended position and the contracted position, the contraction inhibiting members extending axially and radially inward from the inner surface of the tubular side wall, wherein the contraction inhibiting members are deformed during contraction.

2. The bullet assembly of claim 1, the cup component being formed of a deformable polymer material and the cup assembly further comprises a tail component, the tail component being formed of a material that is more rigid that the polymer material of the cup component.

3. The bullet assembly of claim 2, wherein the plurality of contraction inhibiting members have forward surfaces facing the open end and are arranged around the axis, adjacent to the bottom wall, and wherein the tail portion of the bullet includes a bottom aligned with the axis and, when inserted in the cavity, are axially directly confronting the forward surfaces.

4. The bullet assembly of claim 2, wherein the cup component and tail component are formed by overmolding one of the cup component and tail component on the other of the cup component and tail component.

5. The bullet assembly of claim 1 wherein the cup is slidably secured to the bullet such that when the bullet and cup are fired from the muzzleloader, the cup remains secured to the bullet.

6. A bullet assembly for muzzleloading, the bullet assembly having an axis, a forward end, and a rearward end, the bullet assembly having an extended condition wherein the bullet assembly has a first length, and a contracted condition wherein the bullet assembly has a second length, wherein upon the application of a threshold of axial force the bullet assembly transitions from the extended condition to the contracted condition, the bullet assembly comprising:

a bullet aligned along the axis at the forward end and having, in alignment along the axis, a forward tapered end, a rearward tail portion having a recessed portion, and a shoulder portion, wherein the shoulder portion is positioned between the forward tapered end and the recessed portion along the axis; and a cup assembly configured to receive the tail portion of the bullet, the cup assembly being tubularly shaped around the axis and having a forward end positionally secured to the bullet at or adjacent to the shoulder portion and a rearward end, wherein, when the bullet assembly transitions from the extended condition to the contracted condition, the cup assembly axially slides on the tail portion of the bullet.

7. A bullet system for a muzzleloader, the bullet system comprising a bullet body and a cup assembly, the bullet body having a forward tapered end and a rearward tail portion, the cup assembly having an open end with the bullet body inserted therein and a closed end, the cup assembly comprising a cup component and a rigid ring portion with a circular cutting edge positioned at the closed end of the cup assembly for scraping a barrel of the muzzleloader and wherein the ring portion has serrations.

8. The bullet system of claim 7 wherein the ring portion comprises a metal ring.

9. A bullet system for a muzzleloader, the bullet system comprising a bullet body and a cup assembly, the bullet body having a forward tapered end and a rearward tail portion, the cup assembly having an open end with the bullet body inserted therein and a closed end, the cup assembly comprising a cup component and a rigid ring portion with a circular cutting edge positioned at the closed end of the cup assembly for scraping a barrel of the muzzleloader and wherein the ring portion is formed of a polymer more rigid than a polymer of the cup component.

10. The bullet system of claim 9 wherein the maximum diameter of the cup assembly is at the rigid ring portion.

* * * * *